US010733845B2

(12) United States Patent
Suda et al.

(10) Patent No.: US 10,733,845 B2
(45) Date of Patent: Aug. 4, 2020

(54) GAMING MACHINE, CONTROL METHOD FOR MACHINE, AND PROGRAM FOR GAMING MACHINE HAVING A BONUS FEATURE EVENT

(71) Applicant: Konami Gaming, Inc., Las Vegas, NV (US)

(72) Inventors: Satoshi Suda, Zama (JP); William Langston, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 109 days.

(21) Appl. No.: 15/928,902

(22) Filed: Mar. 22, 2018

(65) Prior Publication Data

US 2019/0295377 A1 Sep. 26, 2019

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/3227* (2013.01); *G07F 17/3244* (2013.01); *G07F 17/34* (2013.01)

(58) Field of Classification Search
CPC ..... G07F 17/3267; G07F 17/3213; G07F 17/3227; G07F 17/3244; G07F 17/34
USPC ..... 463/20
See application file for complete search history.

(56) References Cited

U.S. PATENT DOCUMENTS

2003/0036418 A1* 2/2003 Seelig ..... G07F 17/32 463/16
2003/0157978 A1* 8/2003 Englman ..... G07F 17/32 463/16
2005/0261055 A1* 11/2005 Casey ..... A63F 3/00157 463/20
2006/0068893 A1* 3/2006 Jaffe ..... G07F 17/3244 463/20
2009/0075722 A1* 3/2009 Louie ..... G07F 17/32 463/20
2009/0298569 A1* 12/2009 Sims ..... G07F 17/32 463/20
2014/0051496 A1* 2/2014 Meyer ..... G07F 17/3267 463/21
2014/0274316 A1* 9/2014 Elias ..... G07F 17/34 463/25
2017/0372558 A1* 12/2017 You ..... G07F 17/34
2019/0066445 A1* 2/2019 Satterlie ..... G07F 17/3267

* cited by examiner

*Primary Examiner* — Omkar A Deodhar
*Assistant Examiner* — Shauna-Kay Hall
(74) *Attorney, Agent, or Firm* — Howard & Howard Attorneys PLLC

(57) ABSTRACT

A gaming machine is described herein. The gaming machine includes a control unit programmed to initiate an instance of a primary game and spin and stop virtual reel strips to display an outcome of the primary game. The control unit detects an appearance of a winning combination of game symbols in the outcome and provides an initial award based on the winning combination, and detects an appearance of the collect symbol and a credit prize symbol in the outcome, determines an amount of credits associated with the credit prize symbol, and a bonus award including the determined amount of credits.

20 Claims, 35 Drawing Sheets

131

126

| Stop Position | Random Number Range |
|---|---|
| 1 | 1-50 |
| 2 | 51-100 |
| 3 | 101-150 |
| 4 | 151-200 |
| 5 | 201-250 |
| 6 | 251-300 |
| 7 | 301-350 |
| 8 | 351-400 |
| 9 | 401-450 |
| 10 | 451-500 |
| 11 | 501-550 |
| 12 | 551-600 |
| 13 | 601-650 |
| 14 | 651-700 |
| 15 | 701-750 |
| 16 | 751-800 |
| 17 | 801-850 |
| 18 | 851-900 |
| 19 | 901-950 |
| 20 | 951-1000 |

FIG. 30

116

118

82

| Game Symbol | Selection Probability | Random Number Range |
|---|---|---|
| 9 | 20% | 1-200 |
| 10 | 20% | 201-400 |
| J | 10% | 401-500 |
| Q | 10% | 501-600 |
| K | 10% | 601-700 |
| A | 10% | 701-800 |
| PicA | 5% | 801-850 |
| PicB | 5% | 851-900 |
| PicC | 5% | 901-950 |
| PicD | 5% | 951-1000 |

FIG. 31

116

120

84

| Credit Prize Symbol | Amount of Credits | Selection Probability | Random Number Range |
|---|---|---|---|
| Sym-10 | 10 | 20 | 1-200 |
| Sym-15 | 15 | 20 | 201-400 |
| Sym-20 | 20 | 20 | 401-600 |
| Sym-30 | 30 | 20 | 601-800 |
| Sym-60 | 60 | 10 | 801-900 |
| Sym-150 | 150 | 5 | 901-950 |
| Sym-350 | 350 | 1 | 951-960 |
| Sym-700 | 700 | 1 | 961-970 |
| Sym-1000 | 1000 | 1 | 971-980 |
| Sym-1500 | 1500 | 1 | 981-990 |
| Sym-3000 | 3000 | 1 | 991-1000 |

FIG. 32

160

88

| | Trigger Event Symbol | Feature Event | Selection Probability | Random Number Range |
|---|---|---|---|---|
| 90 | Collect | Pay Bonus Credit Balance and Reset Bonus Credit Balance to Initial Credit Value | 40 | 1-400 |
| 92 | End | Terminate Bonus Feature | 30 | 401-700 |
| 94 | Reset | Reset Bonus Credit Balance to Initial Credit Value | 30 | 701-1000 |

FIG. 33

GAMING MACHINE, CONTROL METHOD FOR MACHINE, AND PROGRAM FOR GAMING MACHINE HAVING A BONUS FEATURE EVENT

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit, and a game control unit. The operation unit is configured to receive an operation input of a player. The display unit is configured to display a game screen including computer generated graphics. The game screen includes a display area including a plurality of cells arranged in a grid and configured to display a respective symbol in each cell. The game control unit functions to generate and display the game on the display unit. The game control unit includes a processor coupled to a memory device. The memory device stores a game execution program. The game execution program includes computer instructions for generating a plurality of virtual reel strips including a plurality of game symbols. The game symbols include a plurality of credit prize symbols indicating various credit amounts and a collect symbol indicating an award of credits. The game execution program also includes computer instructions for generating and displaying game instances with the virtual reel strips. The processor is programmed to initiate an instance of a primary game upon detecting an operation input of the player via the operation unit including executing the game execution program to generate and display the plurality of virtual reel strips on the game screen, and randomly select stop positions for each of the virtual reel strips. The processor spins and stops the virtual reel strips based on the randomly selected stop positions to display an outcome of the primary game including game symbols displayed in each cell of the grid, and detects an appearance of a winning combination of game symbols in the outcome and provides an initial award based on the winning combination. The processor detects an appearance of the collect symbol and at least one credit prize symbol in the outcome and responsively determines an amount of credits associated with the at least one credit prize symbol. The processor provides a bonus award including the determined amount of credits associated with the at least one credit symbol, and adjusts a primary credit balance associated with the player based on the initial award and the bonus award.

In another aspect of the present invention, one or more non-transitory computer-readable storage media, having computer-executable instructions embodied thereon is provided. When executed by a processor, the computer-executable instructions cause the processor to display a game screen including computer generated graphics on a display unit. The game screen includes a display area including a plurality of cells arranged in a grid and configured to display a respective symbol in each cell. The processor initiates an instance of a primary game including executing a game execution program including computer instructions for generating a plurality of virtual reel strips including a plurality of game symbols. The game symbols include a plurality of credit prize symbols indicating various credit amounts and a collect symbol indicating an award of credits. The processor generates and displays the plurality of virtual reel strips on the game screen, and randomly selects stop positions for each of the virtual reel strips. The processor spins and stops the virtual reel strips based on the randomly selected stop positions to display an outcome of the primary game including game symbols displayed in each cell of the grid. The processor detects an appearance of a winning combination of game symbols in the outcome and provides an initial award based on the winning combination. The processor detects an appearance of the collect symbol and at least one credit prize symbol in the outcome and responsively determines an amount of credits associated with the at least one credit prize symbol. The processor provides a bonus award including the determined amount of credits associated with the at least one credit symbol, and adjusts a primary credit balance associated with the player based on the initial award and the bonus award.

In still another aspect of the present invention, a mobile computing device is provided. The mobile computing device includes a touch display unit and a processor. The touch display unit is configured to display a game screen including computer generated graphics and receive an operation input of a player. The game screen includes a display area including a plurality of cells arranged in a grid and configured to display a respective symbol in each cell. The processor is programmed to initiate an instance of a primary game upon detecting an operation input of the player via the operation unit including generating and displaying a plurality of virtual reel strips on the game screen including a plurality of game symbols. The plurality of game symbols include a plurality of credit prize symbols indicating various credit amounts and a collect symbol indicating an award of credits. The processor randomly selects stop positions for each of the virtual reel strips and spins and stops the virtual reel strips based on the randomly selected stop positions to display an outcome of the primary game including game symbols displayed in each cell of the grid. The processor detects an appearance of a winning combination of game symbols in the outcome and provides an initial award based on the winning combination. The processor detects an appearance of the collect symbol and at least one credit prize symbol in the outcome and responsively determines an amount of credits associated with the at least one credit prize symbol. The processor provides a bonus award including the determined amount of credits associated with the at least one credit symbol, and adjusts a primary credit balance associated with the player based on the initial award and the bonus award.

BRIEF DESCRIPTION OF DRAWINGS

FIGS. 24-33 are exemplary illustrations of program files that may be used by the gaming machine shown in FIGS. 1A-2 and the server system shown in FIGS. 7 and 8, according to embodiments of the present invention.

Corresponding reference characters indicate corresponding parts throughout the drawings.

DETAILED DESCRIPTION OF EMBODIMENTS

Figure 1A:
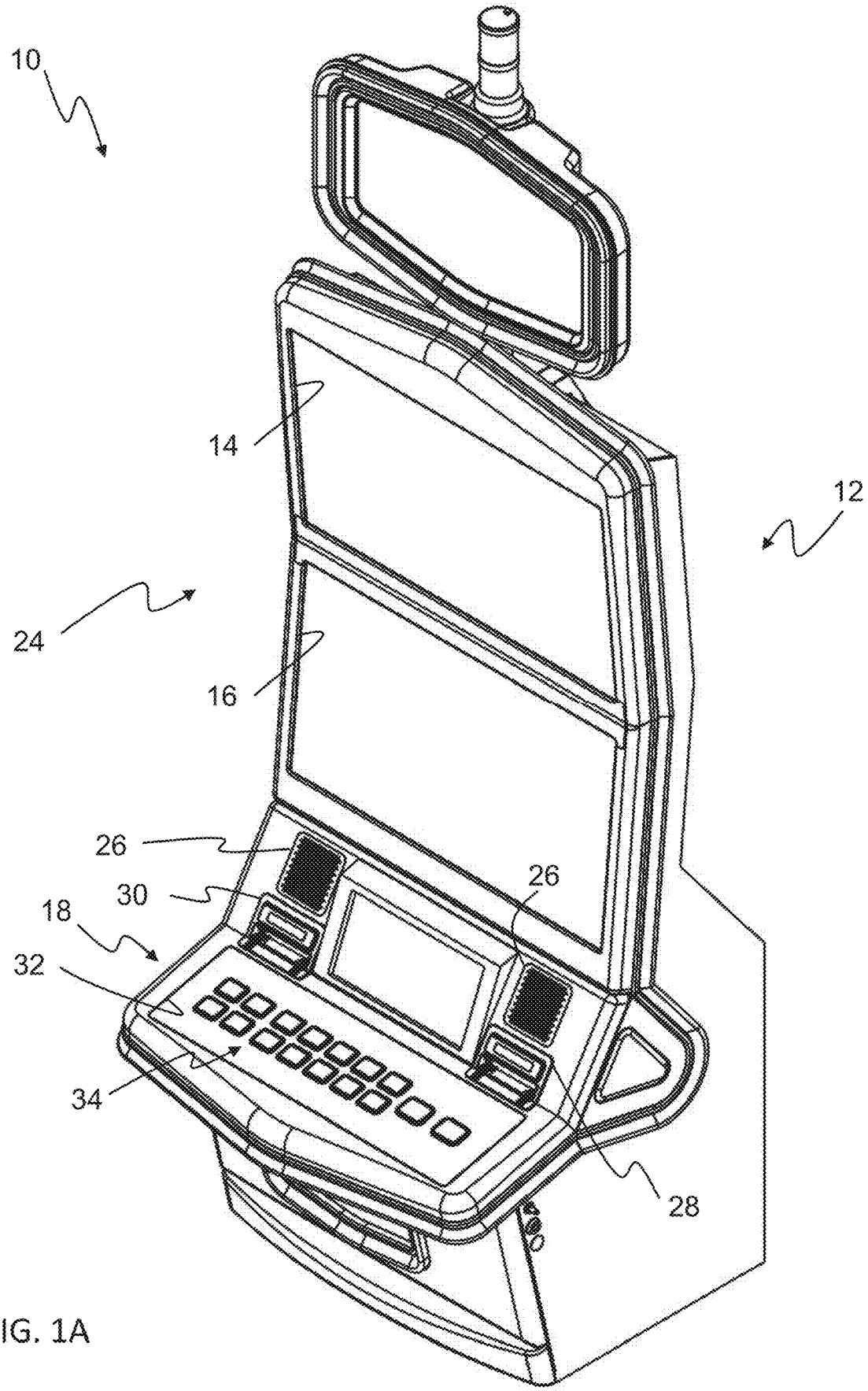
FIG. 1A is a perspective view of the gaming machine, according to the first embodiment.

A gaming machine, according to an embodiment of the present invention, referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine, and a program for a gaming machine and/or mobile computing device that provides a game to a player.

The present invention improves the functionality of existing gaming machines by providing a game execution program including computer instructions executed by a processor to operate a game that includes a primary game and one or more feature(s) and/or bonus game(s). The primary game utilizes a set of symbols displayed with a plurality of virtual reel strips. During the primary game, symbols are selected from a set of symbols and displayed. The symbols in the set of symbols include a plurality of credit prize symbols indicating various credit amounts and a collect symbol indicating an award of credits. Stop positions for each reel are randomly selected, and the virtual reel strips are spun and stopped to display an outcome of the primary game. The symbols displayed in the game outcome are evaluated to determine whether a winning arrangement of symbols is displayed in the outcome, and an initial award is provided based on the winning outcomes, if any. The outcome of the primary game is then evaluated to determine whether one or more credit prize symbols appear in the outcome, and whether the collect symbol also appears in the outcome. If one or more credit prize symbols and the collect symbol appear in the outcome, a bonus award including the amount of credits associated with the credit prize symbols being displayed is provided to the player, and a primary credit balance associated with the player is increased based on the initial award and the bonus award.

A bonus feature game is initiated if a triggering condition is detected during the primary game. For example, the triggering condition is a predetermined number of credit prize symbols being displayed in the outcome of the primary game. During the bonus feature game, a bonus game credit meter is established for use during the bonus feature game and includes an initial credit balance that is based on the amount of credits associated with credit prize symbols appearing in the outcome of the primary game. The bonus feature game includes virtual reel strips displaying a plurality of game symbols that include the plurality of credit prize symbols, a mystery feature event symbol indicating an occurrence of a feature event, and a group of event symbols including the collect symbol indicating an award of credit values, an end symbol indicating a termination of the bonus feature game, and a reset symbol indicating a reset of a balance of the bonus credit meter. During the bonus feature game, the virtual reel strips are randomly spun and stopped. If one or more credit prize symbols appear in the outcome of the bonus feature game, the bonus credit meter is increased based on an amount of credits associated with credit prize symbols. If the mystery feature event symbol appears in the outcome of the bonus feature game, one of the event symbols is randomly selected, and the mystery symbol is removed to display the randomly selected event symbol. If the collect symbol is selected, the current credit balance in the bonus game credit meter is transferred to the primary credit balance associated with the player, and the bonus game credit meter is reset to the initial credit balance. If the reset symbol is selected, the bonus game credit meter is reset to the initial credit balance for use with a subsequent instance of the bonus feature game. If the end symbol is selected, the bonus feature game is terminated and the game screen returns to display the primary game.

The present invention improves existing gaming machine programs by providing a game execution program that includes a bonus feature game having a separate bonus meter, that is increase and/or decreased based on the credit prize symbols and the randomly selected event symbols appearing during the game. Thus increasing the flexibility of providing bonus credit awards to players during the bonus feature event, and increasing the player's interest in playing the game.

Figure 1B:
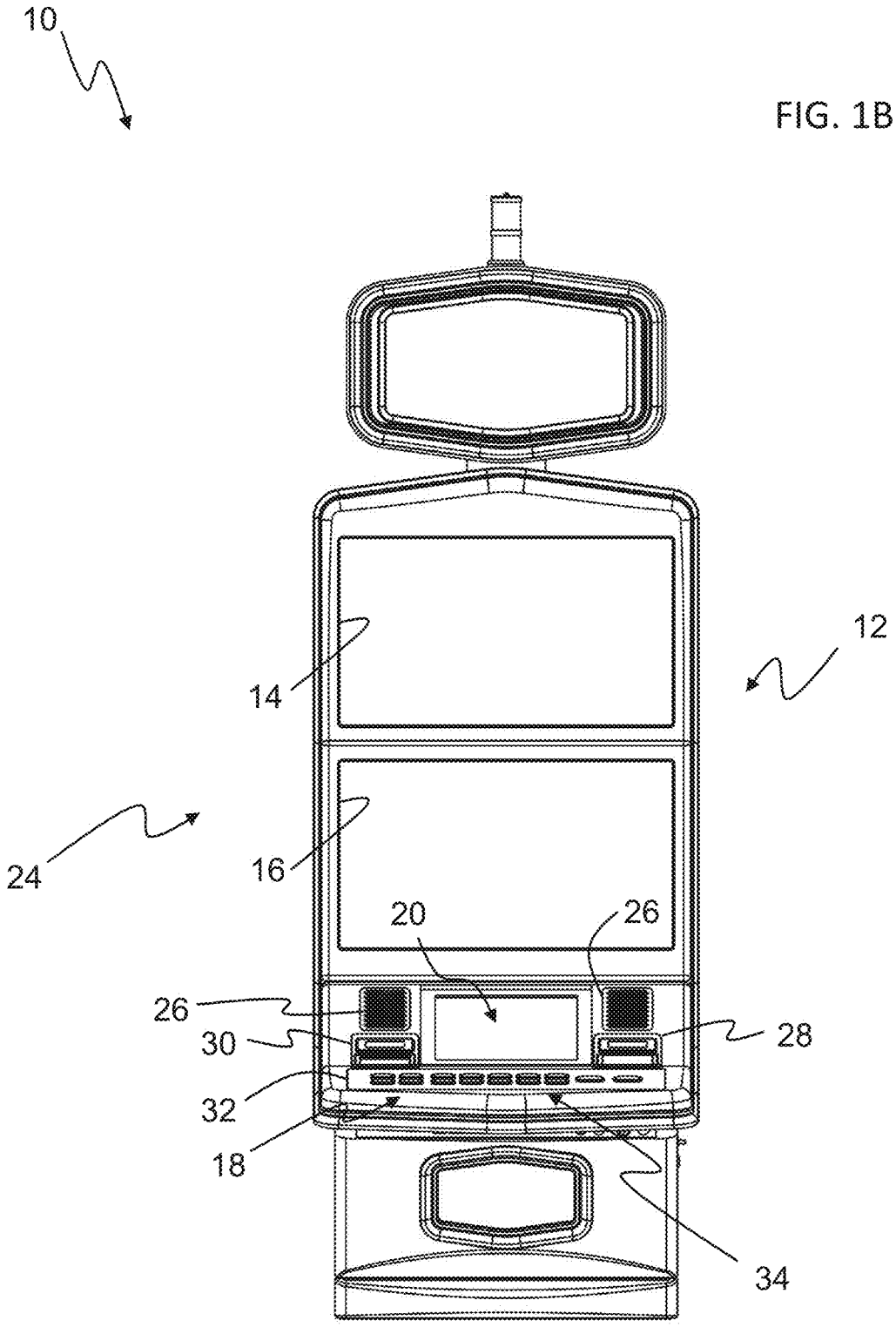
FIG. 1B is a front view of the gaming machine of FIG. 1A.

The gaming machine according to the present embodiment, receives a predetermined game value from the player, generates a game result, and provides a payout to the player according to the game result and one or more pay tables. FIG. 1A and FIG. 1B are a perspective view and a front view, respectively, of a gaming machine 10, according to the present embodiment. As shown in FIG. 1, this gaming machine 10 provides a cabinet 12 providing an upper display 14, a lower display 16, a control panel 18 and may also house a player tracking or ranking unit 20 (see FIG. 2). The cabinet 12 also houses a game control unit 22 (see FIG. 2) that controls each part (see below). The control unit 22 also implements a random number generator (RNG) that is used during operation of the game. Each configuration is described below.

The upper display 14 and the lower display 16 may be flat panel display devices, such as both liquid crystal display devices and organic EL display devices and the like, and by controlling via each control unit 22, the display area mentioned below functions as a display unit 24 provided to the player.

Speakers 26 are provided on the left and right of the cabinet 12, and by controlling via the control unit 22, sound is provided to the player. On the control panel 18, a bill/ticket identification unit 28, a printer unit 30, and an operation unit 32 are provided.

The player tracking unit 20 may be housed on the center of the front surface of the cabinet 12 below the lower display 16. The player tracking unit 20 has a card reader that recognizes a player identification card, a display that presents data to the player, and a keypad that receives input by the player. This type of player tracking unit 20 reads information recorded on the player identification card inserted by the player into the card reader, and displays the information and/or information acquired by communicating with the external system on the display, by cooperatively operating with the control unit 22 mentioned below or an external system. Further, input from the player is received by the keypad, the display is changed according to the input, and communication with the external system is carried out as necessary.

The bill/ticket identification unit 28 is disposed on the control panel 18 in a state where the insertion opening that a bill/ticket is inserted into is exposed, an identification part that identifies a bill/ticket by various sensors on the inside of the insertion opening is provided, and a bill/ticket storage part is provided on the outgoing side of the identification part. The bill/ticket identification unit 28, receives and identifies bills/tickets (including vouchers and coupons) that are the game value as a game executing value, and notifies the control unit 22 mentioned below.

The printer unit 30 is disposed on the control panel 18 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 30, under the control of the control unit 22 mentioned below, prints information on paper and outputs a ticket according to credit payout processing from the gaming machine 10. The output ticket can use the payout credit as game play by being inserted into the bill/ticket identification unit 28 of another gaming machine, or, can be exchanged for cash by a kiosk terminal inside of the casino or a casino cage.

The operation unit 32 receives the operation of the player. The operation unit 32 includes a group of buttons 34 that receives various instructions from the player on the gaming machine 10. The operation unit 32, for example, may include a spin button and a group of setting buttons. The spin button receives an instruction to start (start rotating the reel) the game listed below. The group of setting buttons 34 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line subjected to a line judgment below from the player. The max bet button receives an instruction operation regarding the bet of the maximum amount of credits that can be bet at one time from the player. The payout button receives an instruction operation instructing a credit payout accumulated in the gaming machine 10. The gaming machine 10 also includes illumination 36 that provides decorative lighting to the gaming machine 10.

In one embodiment, referring to FIGS. 1A and 1B, the control panel 18 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 24 and/or the player tracking unit 20, the paper money/ticket identification unit 28, the operation unit 32, the player tracking unit 20, a coin slot, a ticket in ticket out (TITO) system, a bill acceptor, and/or any suitable device that enables the gaming machine 10 to receive media associated with a monetary value and establish a credit balance for use in playing the gaming machine 10. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein.

For example, in one embodiment, the coin slot may include an opening that is configured to receive coins and/or tokens deposited by the player into the gaming machine 10. The control unit 22 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

Figure 2:
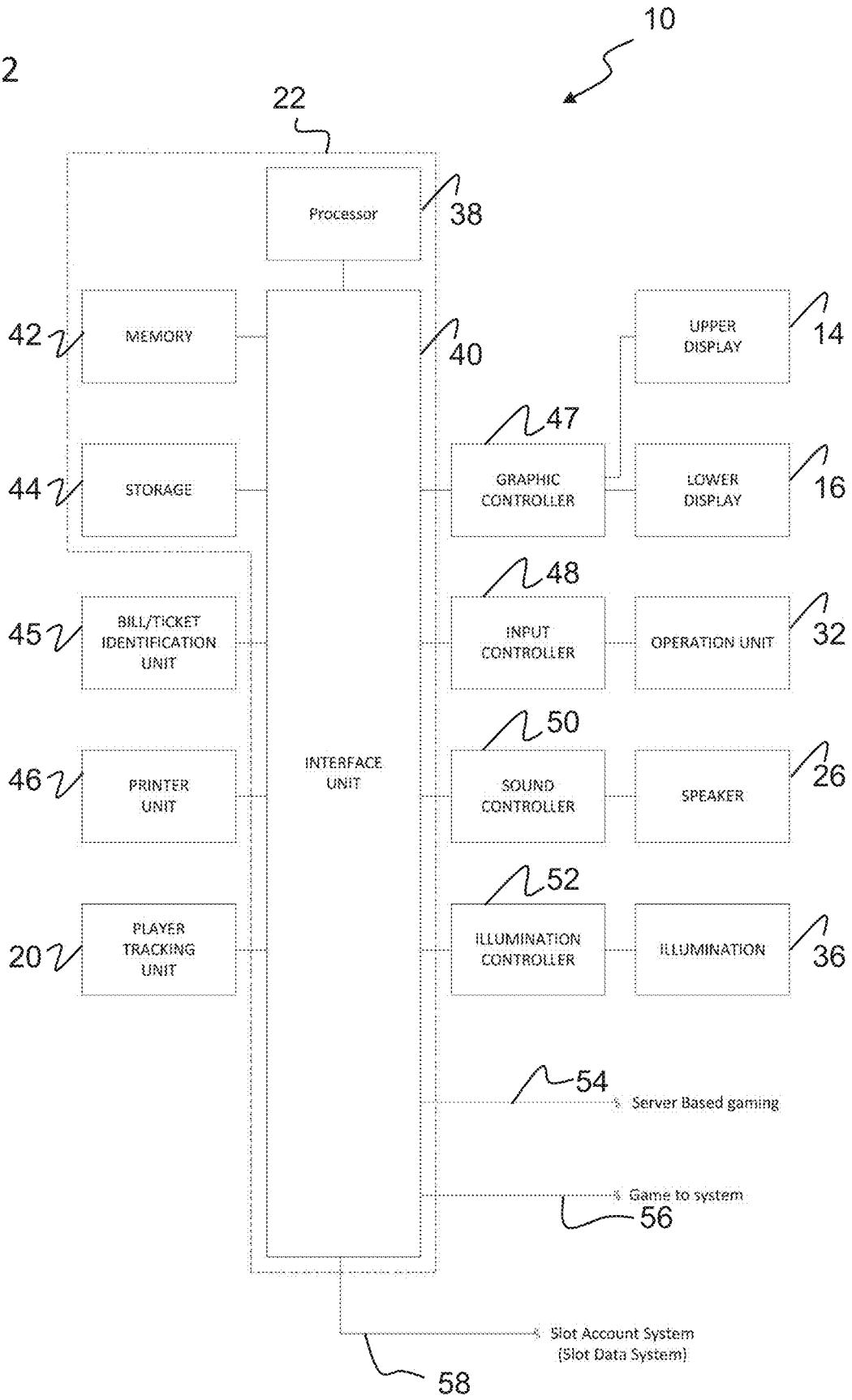
FIG. 2 is a functional block diagram of the gaming machine in FIG. 1A.

With reference to FIG. 2, further on the inside of cabinet 12, a control board equipped with a central processing unit 38 (abbreviated as CPU below) including a processor that configures the control unit 22, an interface unit (or part) 40, a memory 42 and a storage 44 and the like are incorporated. The control board is configured so that communication is possible through the interface unit 40 and each of the components equipped on the cabinet 12, controls the operation of each part by executing the program recorded in the memory 42 or the storage 44 of the CPU 38, and provides a game to the player. The function of the CPU 38 is to execute and display the game on the displays 14, 16 of the gaming machine 10.

FIG. 2 shows a functional block diagram of the gaming machine 10, according to the present embodiment. The gaming machine 10 provides the control unit 22. The control unit 22 is configured as the interface unit 40 including a chip set providing communication functions of the CPU 38, a memory bus connected to a CPU 38, various expanding buses, serial interfaces, USB interfaces, Ethernet (registered trademark) interfaces and the like, and a computer unit where the CPU 38 provides the addressable memory 42 and the storage 44 through the interface unit 40. The memory 42 can be configured to include RAM that is a volatile storage medium, ROM that is a nonvolatile storage medium, and EEPROM that is a rewritable nonvolatile storage medium. The storage 44 provides the control unit 22 as an external storage device function, can use reading devices such as a memory card that is a removable storage medium, and a magneto optical disk and the like, and can use hard disks.

On the interface unit 40, in addition to the CPU 38, the memory 42, and the storage 44, a bill/ticket identification unit controller 45, a printer unit controller 46, the player tracking unit 20, a graphic controller 47, an input controller 48, and a sound controller 50 are connected. That is, the control unit 22 is connected to the operation unit 32 through the input controller 48, and connected to the upper display 14 and/or the lower display 16 through the graphic controller 47. Further, when illumination 36 that provides decorative lighting to the gaming machine 10 is provided, the illumination is controlled under the control of the control unit 22 on the interface unit 40, and an illumination controller 52 that controls the illumination 36 to provide a decorative lighting effect may be connected.

The control unit 22, which includes memory 42 and storage 44, controls each part by executing a program stored in the memory 42 and the storage 44, and provides a game to the player. Here, for example, the memory 42 and storage 44 may be configured to store a program and data of an operating system and subsystem that provide the basic functions of the control unit 22 to the EEPROM of the memory 42, and stores a program and data of an application that provides a game to the storage 44. According to such a configuration, it can be easy to change or update a game by replacing the storage 44. Further, the control unit 22 may be a multiprocessor configuration that has a plurality of CPUs.

Each block connected to the control unit 22 is described below. The bill/ticket identification unit controller 45 operates the bill/ticket identification unit 28 to receive bills/tickets in the insertion opening, and notifies the control unit 22 of identifying information corresponding to the assortment of bills or the payout processing of credits. The bill/ticket identification unit controller 45 notifies the information to the control unit 22, and the control unit 22 increases the usable credit amount inside of the game according to the notified content. The printer unit controller 46 corresponds to the printer unit 30, and under the control of the control unit 22 that receives an operation of the payout button of the group of setting buttons 34, information corresponding to the credit payout processing from the gaming machine 10 is printed and output on a printed ticket.

The player ranking (or tracking unit) unit 20 cooperatively operates with the control unit 22, and sends and receives information and the like of the player from the casino management system. The graphic controller 47 controls the upper display 14 and the lower display 16, under the control of the control unit 22, and displays a display image that includes various graphic data. The sound controller 50 drives the speakers 26 under the control of the control unit 22, and provides various sounds such as an announcement, sound effects, BGM and the like.

Further, the interface unit 40, has various communication interfaces for communicating with the exterior of the gaming machine 10, for example the interface unit 40 can communicate with an external network by Ethernet 54, 56, and a serial interface 58. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3:
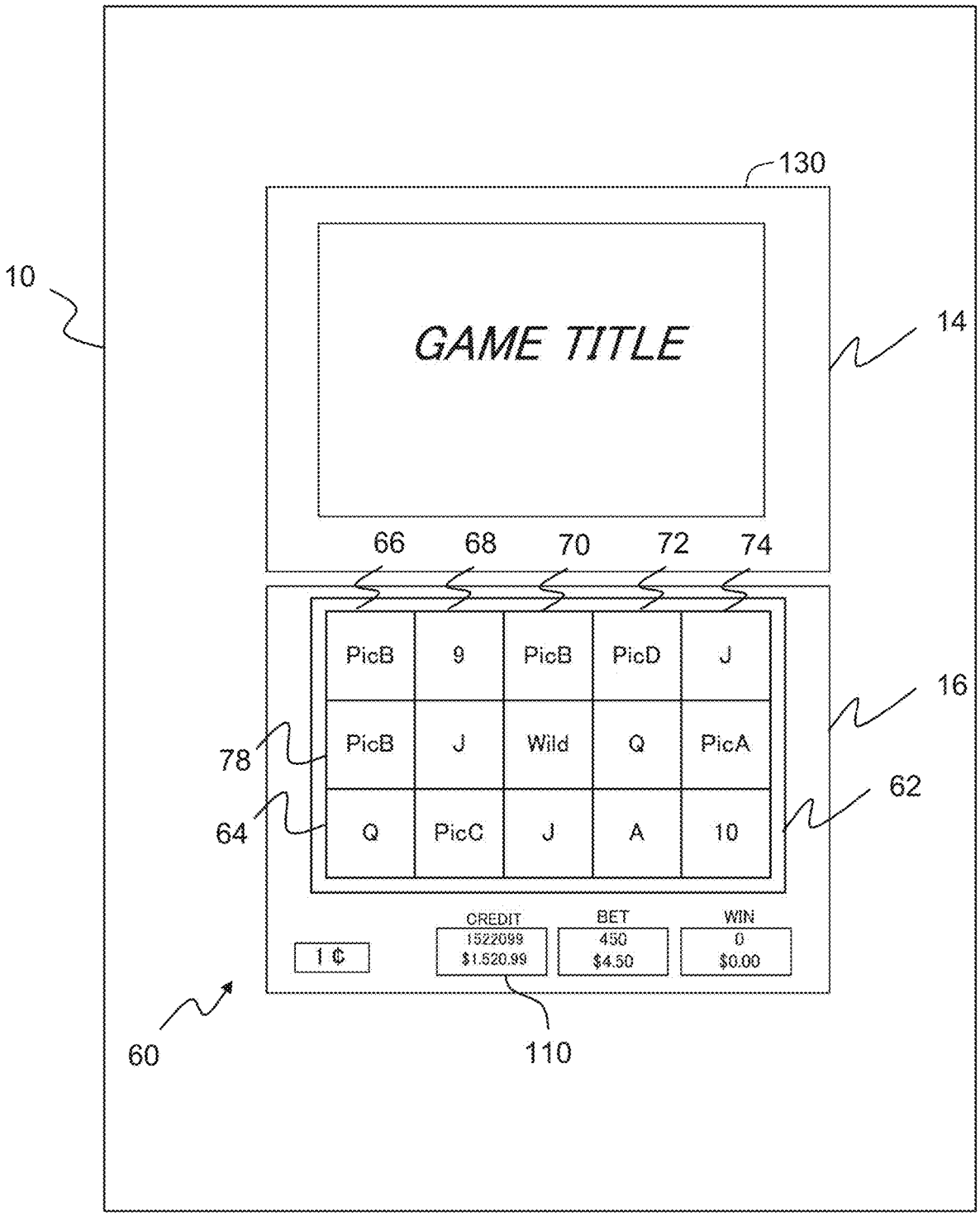
FIG. 3 is a first diagrammatic illustration of a display area of the gaming machine in FIGS. 1A-2, according to an embodiment of the present invention.

FIG. 3 schematically shows a display area 60 provided by the gaming machine 10. Such a display area 60 is displayed on the display unit 24 (the upper display 14 and/or the lower display 16) by the control unit 22 executing a predetermined program. In the illustrated embodiment, the display area 60 is displayed on the lower display 16. For instance, as shown, during the primary game and/or the bonus game, the upper display 14 may be utilized to display game related information, e.g., game title information and/or graphics.

In one aspect of the present invention, the gaming machine 10 provides a game to the player. The game may include a primary game and a game feature. The game feature may include one or more of (1) a multiplier applied to an award or payline, (2) a number of free games or spins, and/or (3) a bonus game. For instance, the primary game may be a video slot game, and the game feature may be the awarding of a number of free games or spins in response to the occurrence of a trigger condition, e.g., during the primary game. During the free spins, the game feature may also be provided.

Returning to FIG. 3, the game of the present invention utilizes a grid 62 in the display area 60 during the primary game and the free spins (if provided). The illustrated embodiment shows the state of displaying the display area 60 in the lower display 16. As shown in FIG. 3, the display area 60 includes the grid 62 for displaying symbols. By using such a display area, the gaming machine 10 of the present embodiment operates as a slot machine that pays a payout according to a winning combination of symbols displayed on the display area 60.

The display unit 24 displays a plurality of symbols in the grid 62. The grid 62 has a plurality of rows (r) and columns (c). The grid 62 is configured by a plurality of cells 64 that are the stop position of symbols.

With reference to FIG. 3, the grid 62 may be displayed on the lower display 16. The upper display 14 may be used to display animations and/or game identifying information during the primary game and/or during an attract mode. Further, the display unit 24 can display a decorative area, and an area that displays credit amount, bet number, and a credit amount obtained by winning (WIN number) and the like, outside of the grid 62. On each of the plurality of cells 64 of the display area 60, one symbol is stopped and displayed.

Figure 4A:
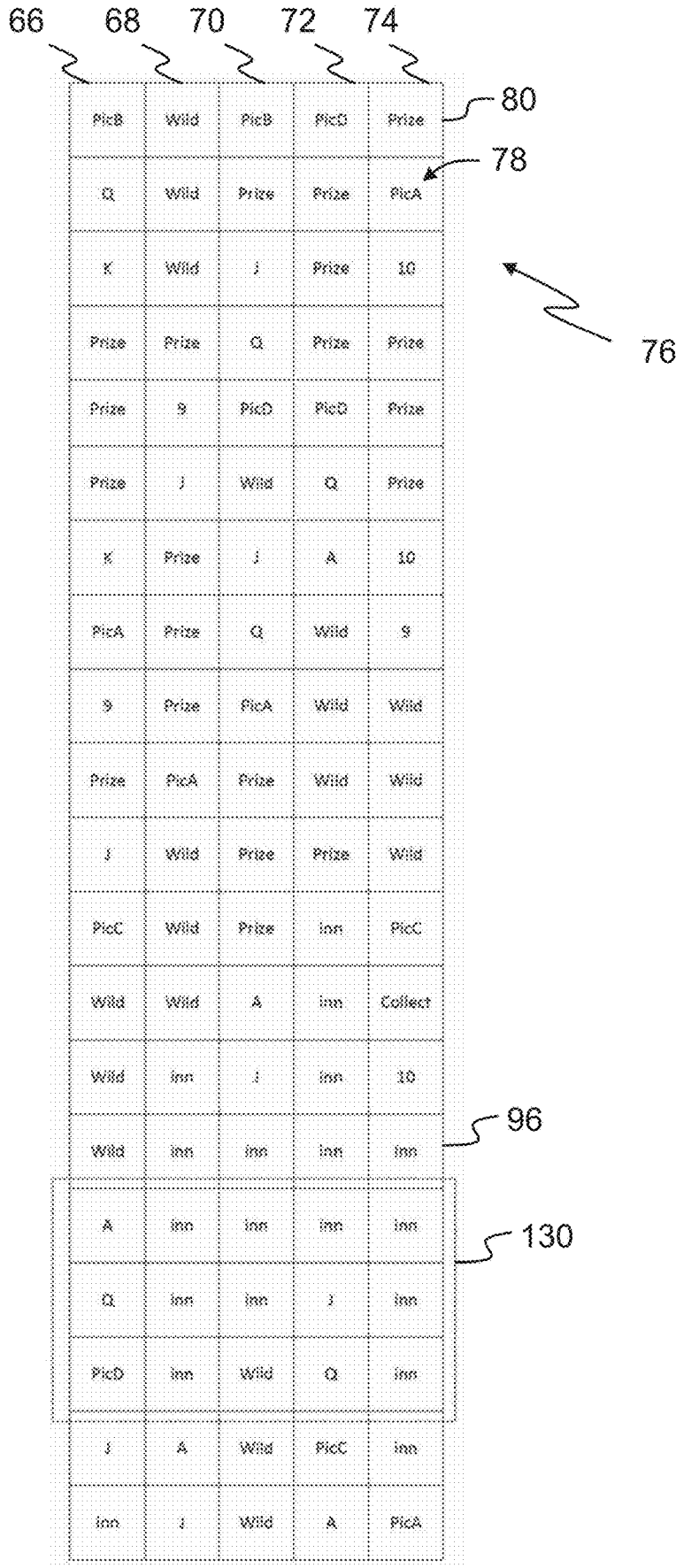
FIGS. 4A and 4B are figures showing exemplary virtual reel strips with symbol arrangements showing the order of symbols displayed on the display area, according to an embodiment of the present invention.

On each cell 64 of the grid 62, as shown in FIGS. 3 and 4A, a symbol is displayed based on the symbol arrangement of virtual reel strips 66, 68, 70, 72, and 74 configured as a virtual reel set 76. That is, the cells 64 of the grid 62 correspond to the virtual reel strips 66 to 74 by column, and the symbols disposed on predetermined parts of each virtual reel strip 66 to 74 are displayed. Furthermore, by moving (scrolling or spinning) each symbol by column based on the symbol arrangement of the virtual reel strips 66 to 74, the symbols displayed in the cells 64 of the grid 62 change, and by stopping the movement (scrolling or spinning) by columns, the symbols are stopped. Here, the virtual reel strips 66 to 74 are data where the control unit 22 uses a program having the memory 42 or the storage 44, and data showing the symbol arrangement (i.e., the order of symbols on each reel strip) regulated by each cell column. Further, the virtual reel set 76 is a general term for such virtual reel strips 66 to 74.

Figure 4B:
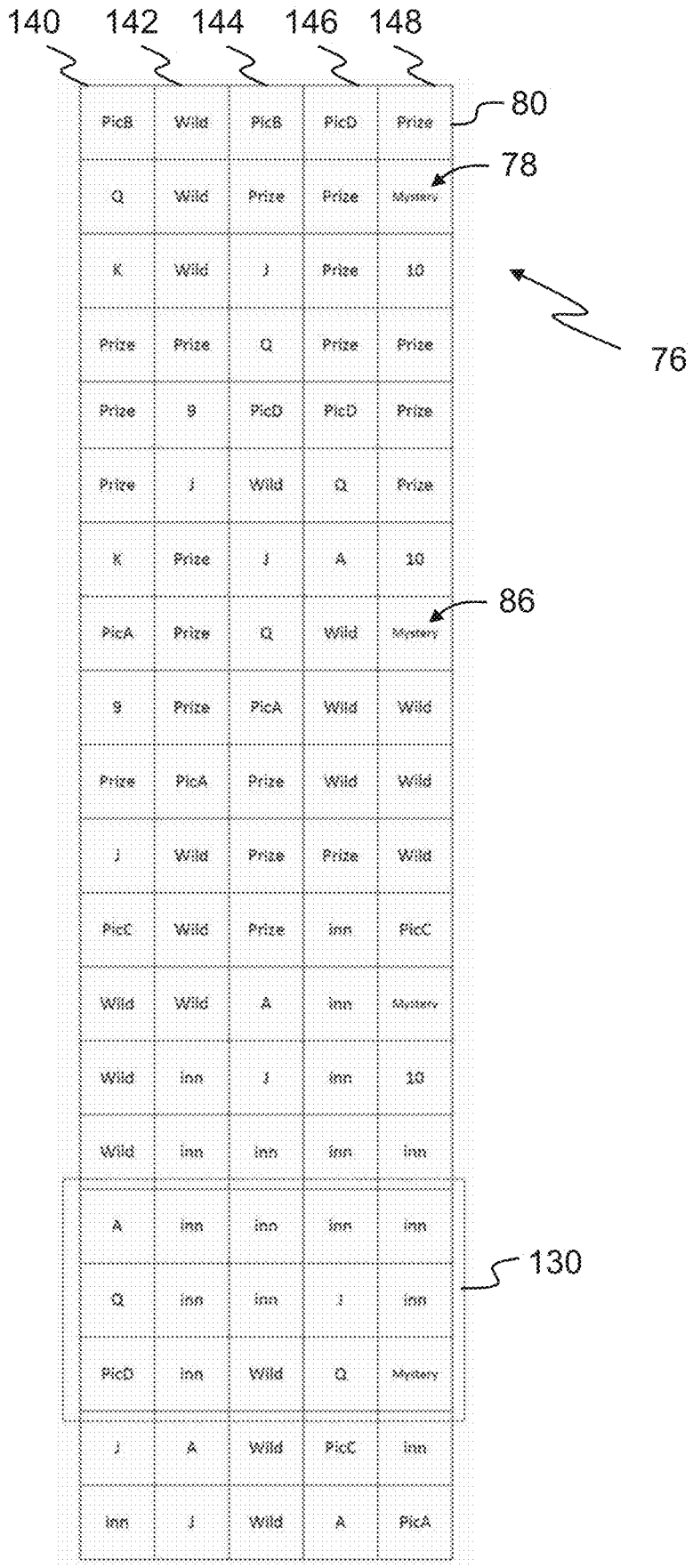
Figure 5:
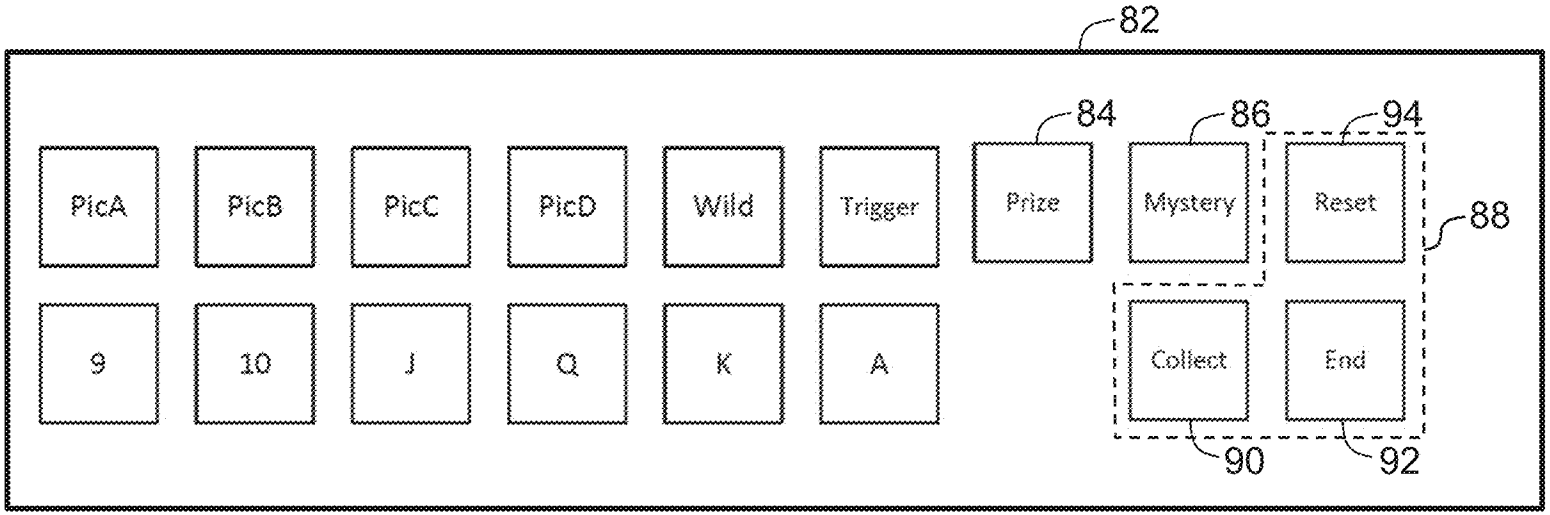
FIG. 5 is a figure showing the symbols displayed on the display area, according to an embodiment of the present invention.

Each virtual reel strip 66 to 74, in the examples of FIGS. 4A and 4B, may be configured by 20 symbols 78 in respective symbol positions 80, and those symbols are aligned in an order defined by each reel. FIG. 5 is the details of symbols 78 of the figure shown in FIGS. 4A and 4B. Each virtual reel strip 66 to 74 includes symbols selected from a symbol set 82 of varieties of symbols 78 shown in FIG. 5. This symbol set 82 includes card symbols ("9", "10", "J", "Q", "K", and "A") that imitate playing cards as regular symbols, and picture symbols ("PicA", "PicB", "PicC", and "PicD") that show a pattern. Further, this symbol set 82 includes a wild symbol ("Wild") that is substituted as another symbol when a win combination is determined and a trigger symbol ("Trigger") that may be used to determine if a game feature is to be provided (see below). Each of these symbols have a different rank from each other regarding their value when winning, their rank gradually raises in this order: "9", "10", "J", "Q", "K", "A", "PicE", "PicD", "PicC", "PicB", "PicA". A combination of symbols that includes high-ranking symbols when winning, can obtain a larger winning payout compared to a combination of low-ranking symbols when winning.

As discussed above in one aspect of the present invention, the set of symbols may be divided into a first sub-group and a second sub-group. In the illustrated embodiment, the first sub-group includes the symbols "9", "10", "J", "Q", "K", and "A", and the second sub-group includes the symbols "PicE", "PicD", "PicC", "PicB", and "PicA". It should be noted that each symbol in the second sub-group have a higher ranking than all of the symbols in the first sub-group of symbols.

Figures 13A, 13B, 13C, 13D:
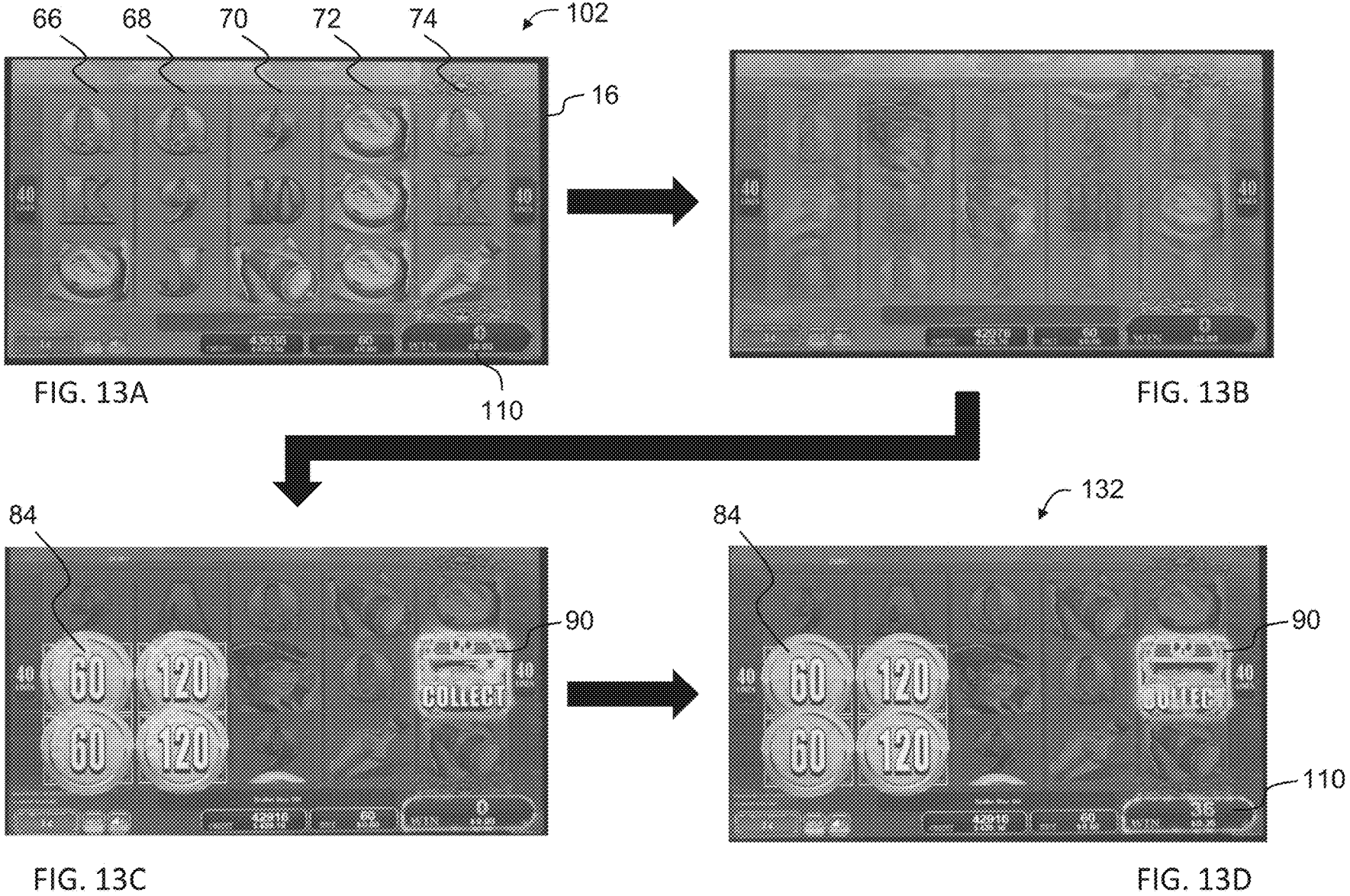
FIGS. 13A-13D are illustrations of a sequence of graphic images that may be used to display the game shown in FIGS. 12A-12D, according to an embodiment of the present invention.

In the illustrated embodiment, the symbol set 82 includes a plurality of credit prize symbols 84 ("Prize"), a mystery feature event symbol 86 ("Mystery"), a group of event trigger symbols 88 that include a collect symbol 90 ("Collect"), an end symbol 92 ("End"), and a reset symbol 94 ("Reset"). Each credit prize symbol 84 indicates various credit amounts that may be awarded to the player during a game. In one embodiment, as shown in FIGS. 13C-13D and 32, the various credit amounts may include credit amount value chosen from 10, 15, 20, 30, 60, 150, 350, 700, 1000, 1500 and 3000 credits for each game. The mystery feature event symbol 86 indicates an occurrence of a feature event such as, for example, an award of a credit prize, a reset of a credit meter, and/or a termination of a bonus feature game. The collect symbol 90 indicates an award of an amount of credits, the end symbol 92 indicates a termination of a bonus feature game, and the reset symbol 94 indicates a reset of a balance of a bonus credit meter.

Returning to FIGS. 4A-4B, in one embodiment, some of the symbol positions have a fixed symbol and others of the symbol positions have a varying symbol, represented by an inner symbol 96 ("inn"). In the illustrated embodiment, for each play of the game, the fixed symbol positions have an associated predefined symbol from the set of symbols 82, and the varying symbol 96 has a symbol that is randomly selected from the symbol set 82. For example, in one embodiment of the present invention, for each play of a game, one of the symbols from a sub-group of symbols included in the symbol set 82 is randomly selected and associated/displayed in the varying symbol positions 96. The sub-group may include, for example, "PicA", "PicB", "PicC", "PicD", "PicE", "A", "K", "Q", "J", "10", and "9". In one embodiment, the same randomly selected symbol from the second sub-group of symbols is associated with or displayed in the varying symbol positions.

In another aspect of the present invention, all of the varying symbol positions or feature symbol positions (indicated as "inn") are arranged in groups (or stacks) of adjacent symbol positions (within a reel strip).

It should be noted that in one aspect of the present invention, one or more dynamic virtual reel strips may be utilized. Using virtual reel strips, the symbols and/or symbol positions and/or virtual reel strips and/or length or size and/or any aspect of a virtual reel strip may change from one spin or play to the next. For example, a dynamic reel strip includes a plurality of symbol positions with symbols from the symbol set 82 and a plurality of varying symbol positions ("inn"). The varying symbol positions may be in the form of one or more stacks, i.e., adjacent symbol positions. In one embodiment, the location and/or size of the stacks may change from one spin to the next, either randomly and/or in a predetermined pattern.

Alternatively, a virtual reel strip associated with a cell 64 (or column of cells 64) may be dynamically changed from one spin or play to another spin or play. This, may occur randomly, every spin or play and/or in a predetermined pattern.

It should be noted that in the illustrated embodiment, each column of the grid 62 has a corresponding reel strip. When the reel strip stops, a symbol from the respective reel strip appears in each one of the cells of the respective column of the grid 62. One or more of the reel strips 66 to 74 may be identical or all of the reel strips 66 to 74 may be different.

In an alternative embodiment, however, each cell 64 of the grid 62 has a respective independent reel that may spin independently of the other reels. Each cell 64 of the grid 62 may, thus, have an independent reel with a corresponding virtual reel strip 66 to 74. The virtual reel set 76 may include different number of virtual reel strips in such a case. For example, in an example in which a 3×5 grid is utilized, each cell 64 would have an associated virtual reel strip, so fifteen reel strips would be utilized. As above, one or more of the fifteen virtual reel strips may be identical or all reel strips may be different.

In the next several embodiments, the present invention will be described with respect to a 3×5 grid, however, it should be noted that the present invention is not limited to a grid with any specific size and/or shape. Furthermore, the below discussion describes a game having a primary game and a bonus feature game. The bonus feature game provides a plurality of free games and/or spins.

In general, the control unit 22 starts a game (either the primary game or a free spin in the bonus game) and determines the stop position of each virtual reel strip 66 to 74 randomly. The virtual reel strips 66 to 74 that are displayed in the display unit 24 (for example, the lower display 16) are moved from a current position, and stopped based on a stop position to express an outcome of the game. Due to this, in the display or grid 62, the symbols included on the virtual reel strips 66 to 74 are continuously moved (scrolled or spun) in a vertical direction of the display area 60, and one symbol of one cell 64 is aligned in an order of the symbol based on the symbol arrangement is stopped so that it is displayed.

The control unit 22 changes and stops the plurality of symbols displayed on the display unit 24 according to the operation of the player received by the operation unit 32, and a payout may be paid according to the stopped symbols inside the display area 60.

In the display area 60, a pay line is set that is used when winning is determined. The pay line is set to be extended over the column on the right end from the cells of the column of the left end, and is a line that combines the plurality of cells 64 determining a win. The number of effective lines within the set pay line is selected by the operation of a group of line designation buttons included in the group of setting buttons 34 of the operation unit 32 for the player. The control unit 22, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 60 is set (see FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line. In addition, more than a predetermined number of the "Trigger" form a win combination or trigger condition regardless of the pay line.

Figure 6:
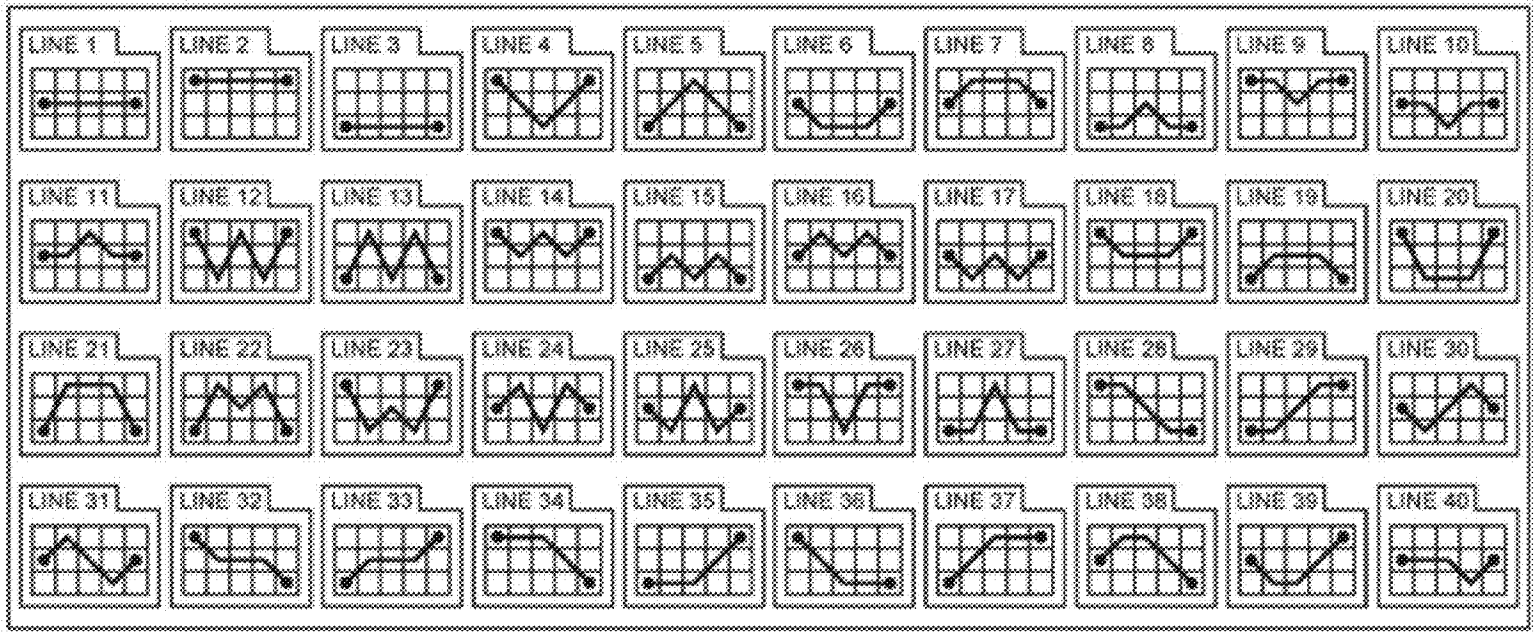
FIG. 6 is a figure showing one example of a pay line set on the determination area in FIG. 3.

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

Referring to FIGS. 3, 12A-27, in the illustrated embodiment, the memory 42 stores a game application program 98 (shown schematically in FIGS. 24-27) that includes computer executable instructions that, when executed by the processor 38, cause the processor 38 to generate and display the game on the display unit 24 of the gaming machine 10. In one embodiment, the game application program 98 includes program code 100 and program object data 101 that includes computer executable instructions for implementing a primary game 102 (show in FIGS. 12A-15D) using the algorithm shown in FIG. 10, and a bonus feature game 106 (show in FIGS. 16A-23C) using the algorithm shown in FIG. 11. The game application program 98 may also include instructions for establishing a primary credit meter 110 (shown in FIG. 3) associated with the player that includes a credit balance that may be used by the player to initiate plays of the game.

In the illustrated embodiment, the game application program 98 includes instructions for generating the virtual reel strips 66 to 74 shown in FIG. 4A, using data files stored in storage 44. For example, the game application program 98 may include instructions for generating virtual reel strips 66 to 74 using a reel strip data files 114 (shown in FIGS. 28 and 29), symbol image object data including information for generating computer graphics associated with the game symbols included with the symbol set 82 shown in FIG. 5, and symbol selection data files 116 (shown in FIGS. 31 and 32). In one embodiment, the reel strip data files 114, the symbol image object data, and the symbol selection data file 116 may be stored in storage 44 and accessible by the memory 42. In the illustrated embodiment, the symbol selection data files 116 may include a varying symbol selection file 118 (shown in FIG. 31) and a credit prize symbol selection file 120 (shown in FIG. 32). The varying symbol selection file 118 includes information for use in randomly selecting a game symbol from the symbol set 82 that is displayed in the varying symbol positions 96. For example, as shown in FIG. 31, in one embodiment, the varying symbol selection file 118 may include a selection probability and/or a random number range associated with each game symbol included in the sub-group of the symbol set 82 that may be displayed in the varying symbol positions 96.

The credit prize symbol selection file 120 includes information for use in randomly selecting a credit prize symbols 84 that are displayed with the virtual reel strips. For example, during a play of a game, the processor may randomly select a credit prize symbol 84 for each symbol position indicated to display a credit prize symbol in the reel strip data files 114. In one embodiment, the game application program 98 may include instructions to randomly select the credit prize symbols prior to each spin, or at the start of a bonus feature game for use with each free spin of the bonus feature game. As shown in FIG. 32, in one embodiment, the credit prize symbol selection file 120 may include a selection probability and/or a random number range associated with each credit prize symbol 84 and amount of credits. In one embodiment, credit prize symbols 84 having a larger credit amount may have a lower selection probability than credit prize symbols 84 having smaller credit amount.

Figure 28:
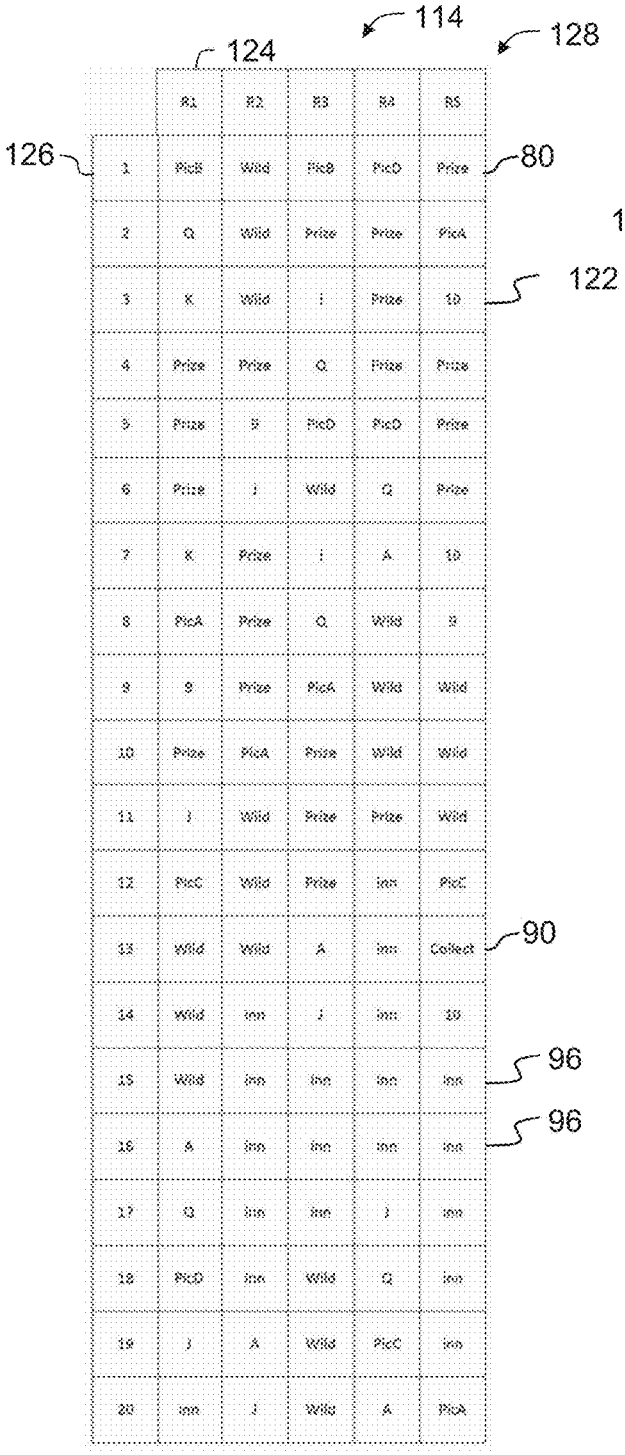
Figure 29:
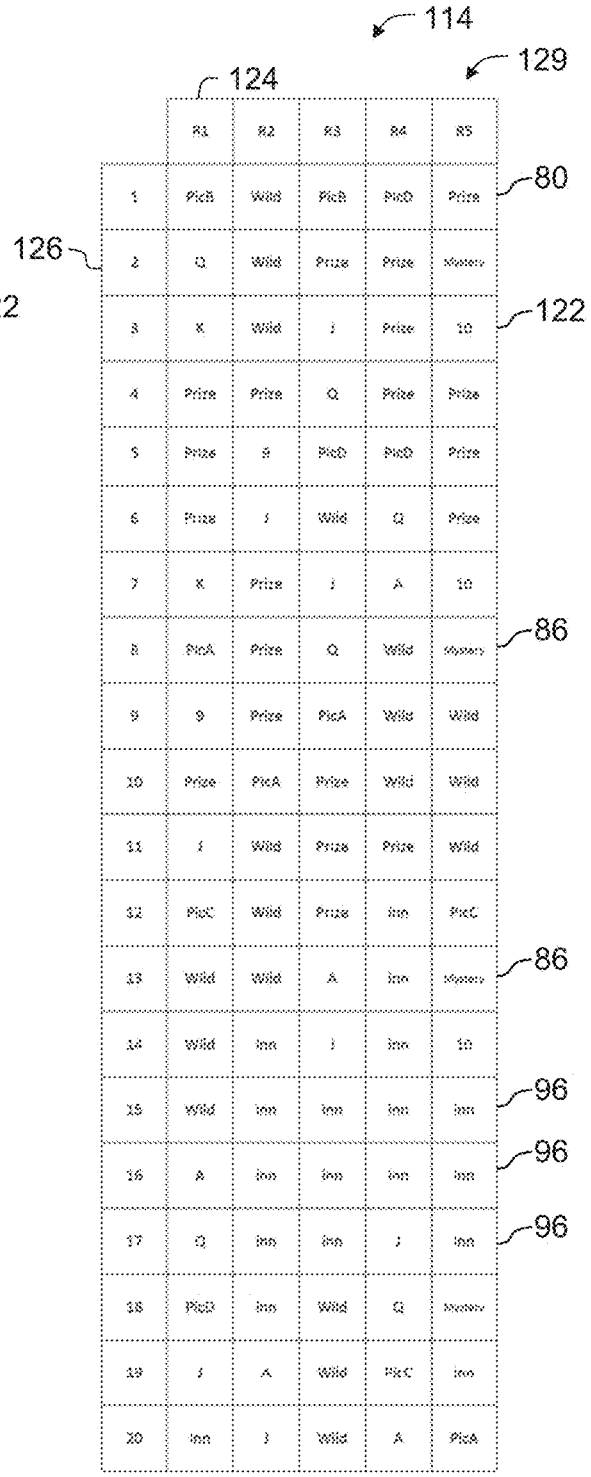

Referring to FIGS. 28-29, in one embodiment, the reel strip data files 114 includes a matrix of logic cells 122 including information for generating a virtual reel and/or virtual reel set. For example, the reel strip data files 114 may include a reel designation 124 indicating a corresponding virtual reel, a plurality of sequential symbol position logic cells 122, and a stop position 126 associated with each symbol position logic cell 122. Each symbol position logic cell 122 includes information indicating a type of symbol to be displayed in the corresponding symbol position. When executing the game application program 98, the processor 38 accesses the reel strip data files 114 and identifies a reel designation 124 associated with the virtual reel being generated, accesses each sequential symbol position logic cell 122 to retrieve instructions for generating and displaying the corresponding game symbols, and generates the corresponding virtual reel based on the instructions associated with each sequential symbol position logic cell 122. For example, a symbol position logic cell 122 may include instructions to display a fixed game symbol ("PicA", "PicB", "PicC", "PicD", "PicE", "A", "K", "Q", "J", "10", and "9") from the symbol set 82, to randomly select a credit prize symbol 84 ("Prize") using the credit prize symbol selection file 120 and display the randomly selected credit prize symbol 84 in the corresponding symbol position, to randomly select a varying symbol ("inn") using the varying symbol selection file 118 and to display the randomly selected symbol in each varying symbol position, to display a mystery feature event symbol 86 ("Mystery"), and/or to display an event trigger symbols 88 including a collect symbol 90 ("Collect"), an end symbol 92 ("End"), and a reset symbol 94 ("Reset").

In the illustrated embodiment, the reel strip data files 114 include a primary game reel strip data file 128 (shown in FIG. 28) and a bonus game reel strip data file 129 (shown in FIG. 29). The processor 38 uses the primary game reel strip data file 128 for generating virtual reel sets used in the primary game 102, and uses the bonus game reel strip data file 129 for generating virtual reel sets used during the bonus feature game 106. For example, as shown in FIG. 4A, the processor 38 may execute the game application program 98 using the primary game reel strip data file 128 to generate a virtual reel set 76 for use with a primary game 102 (shown in FIGS. 12A-15D) that includes virtual strips 66 to 74 having a plurality of game symbols including groups of varying symbols ("inn"), fixed symbols from the symbol set 82, a plurality of credit prize symbols 84 indicating various credit amounts and a collect symbol 90 indicating an award of credits. In one embodiment, one or more collect symbols 90 may only be displayed on the $5^{th}$ virtual reel 74.

Figure 9:
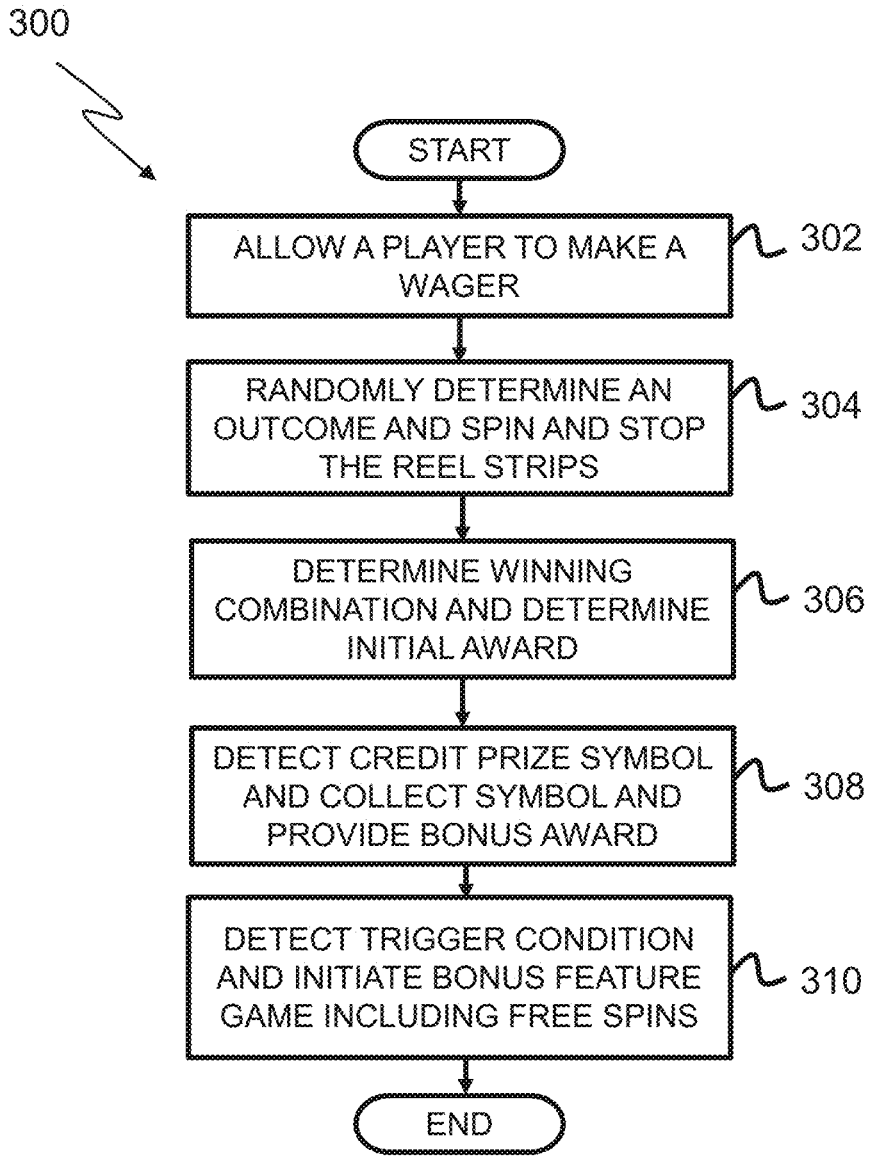
FIGS. 9-11 are flow charts describing the operation of the gaming machine during a game, according to one embodiment of the present invention.
Figure 10:
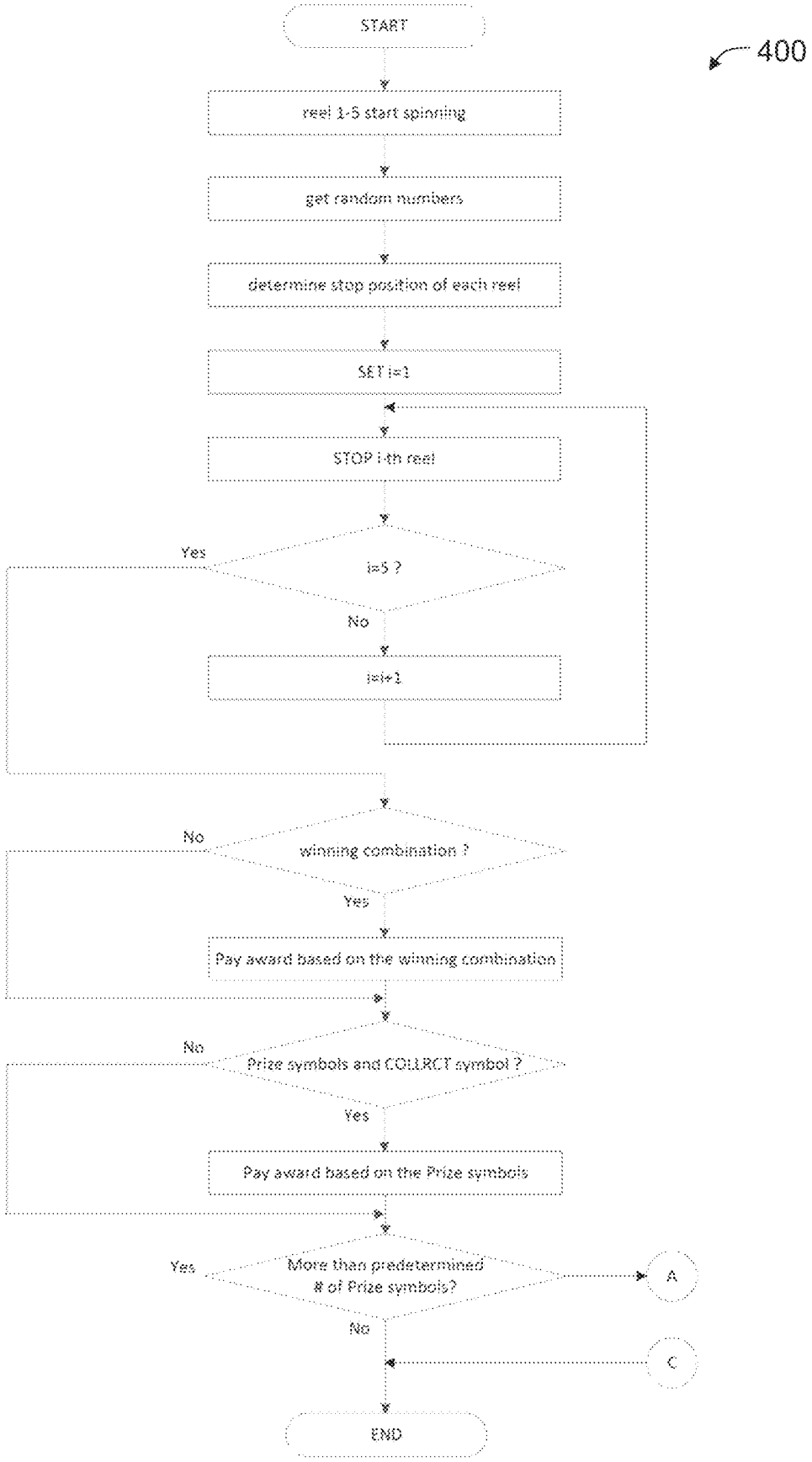

In the illustrated embodiment, game application program 98 includes instructions for executing the algorithm show in FIGS. 9 and 10 and to display the sequence of images shown in FIGS. 12A-15D including instructions to display a game screen 130 on the display unit 24 including the virtual reel strips 66 to 74 displayed on the lower display 16, generating random numbers using the random number generator for use in selecting reel stop positions, spinning and stopping the virtual reels to display an outcome of the play of the game including a combination of game symbols, determine any winning combinations of symbols and associated awards, and to detect triggering conditions occurring during the primary game that may initiate bonus feature games.

In one embodiment, the game application program 98 may include instructions for selecting reel stop positions using a stop position data file 131 (shown in FIG. 30). The stop position data file 131 includes a plurality of stop positions 126 and a random number range associated with each stop position 126. During play of the primary game 102 and/or the bonus feature game 106, the processor 38 generating one or more random numbers using the random number generator, executes the stop position data file 131 to select the stop positions 126 that correspond to the generated random numbers, and spins and stops the virtual reels at the selected stop positions to display an outcome of the play of the game.

The game application program 98 may also include instructions to generate a credit prize collection event 132 (shown in FIGS. 12A-13D) and/or a bonus feature game trigger event 134 (shown in FIGS. 14A-15D). For example, with reference to FIGS. 12A-13D, in one embodiment, when executing the game application program 98 the processor 38 may initiate an instance of the primary game 102 upon detecting an operation input of the player via the operation unit 32 and generate and display the plurality of virtual reel strips 66 to 74 on the game screen. The processor 38 randomly selects stop positions for each of the virtual reel strips 66 to 74 using random numbers obtained from the RNG, and spins and stops the virtual reel strips 66 to 74 based on the randomly selected stop positions to display an outcome of the primary game 102 including game symbols displayed in each cell of the grid. The processor 38 detects an appearance of a winning combination of game symbols in the outcome based on the paylines shown in FIG. 6, and provides an initial award based on the winning combination of symbols and a paytable. The processor may also detect an appearance of the collect symbol 90 and one or more credit prize symbols 84 in the outcome and responsively initiate the credit prize collection event 132 including determining an amount of credits associated with the credit prize symbols 84, and provide a bonus award including the determined amount of credits associated with the credit prize symbols 84, and adjust the primary credit balance 110 associated with the player based on the initial award and the bonus award.

The processor 38 may also detect a triggering condition occurring with the primary game 102 and initiating the bonus feature game trigger event 134. For example, as shown in FIGS. 14A-15D, the processor 38 may detect predefined number of credit prize symbols 84 appearing in the outcome of the primary game 102 and initiate the bonus feature game 106 including establishing a bonus game credit meter 136 for use during the bonus feature game. The processor 38 may establish the bonus game credit meter 136 with an initial credit balance based on an amount of credits associated with credit prize symbols appearing in the outcome of the primary game 102, and display the bonus game credit meter 136 on the game screen 130.

In one embodiment, the processor 38 may use the bonus game reel strip data file 129 to generate bonus virtual reel strips 140, 142, 144, 146, and 148 (shown in FIG. 4B) with the credit prize symbol selection file 120 and the varying symbol selection file 118, as described above. In one embodiment, as shown in FIG. 4B, when using the bonus game reel strip data file 129, the processor 38 may generate the bonus virtual reel strips 140 to 148 having a plurality of game symbols including groups of varying symbols ("inn"), fixed symbols from the symbol set 82, a plurality of credit prize symbols 84 indicating various credit amounts, and the mystery feature event symbol 86 indicating an occurrence of a feature event. In one embodiment, one or more mystery feature event symbols 86 may only be displayed on the $5^{th}$ bonus virtual reel 148.

Figure 11:
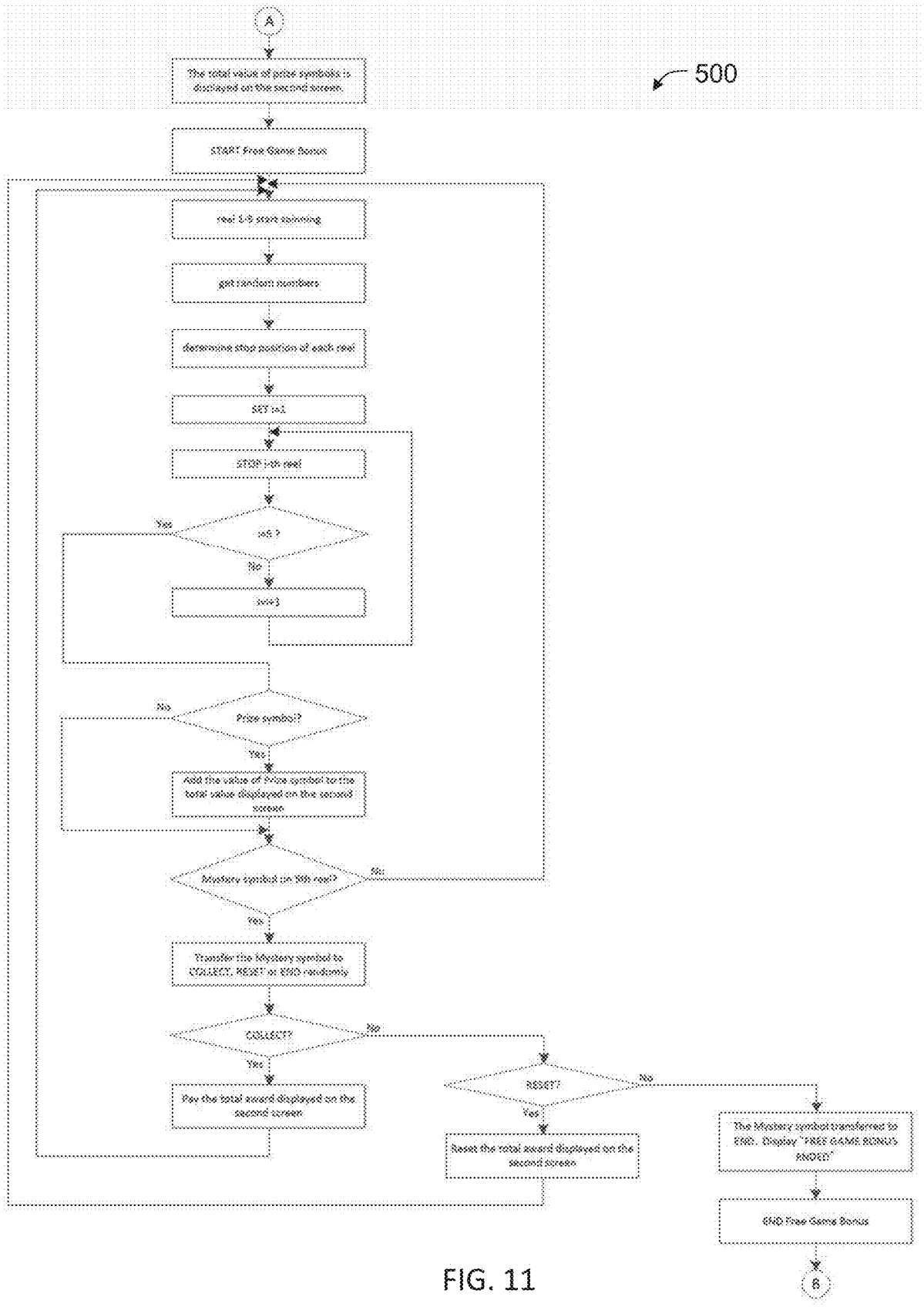

The game application program 98 also includes instructions for executing the algorithm show in FIGS. 9 and 11 and to display the sequence of images shown in FIGS. 16A-23C using the bonus virtual reel strips 140 to 148. For example, game application program 98 includes instructions for generating random numbers using the random number generator for use in selecting reel stop positions, spinning and stopping the virtual reels to display an outcome of the play of the game including a combination of game symbols, determine any winning combinations of symbols and associated awards, and to detect triggering conditions occurring during the bonus feature game that may initiate bonus feature game events. In one embodiment, the game application program 98 may also include instructions to generate and display a bonus credit prize collection event 152 (shown in FIGS. 16A-19C), a bonus meter reset event 154 (shown in FIGS. 20A-21F), and a termination feature event 156 (shown in FIGS. 22A-23C). In addition, the game application program 98 includes instructions for establishing a bonus credit meter 136 for use during the bonus feature game 106.

For example, with reference to FIGS. 16A-23C, in one embodiment, when executing the game application program 98, the processor may initiate the bonus feature game 106 including a plurality of free spins. The processor 38 may generate and display a plurality of bonus virtual reel strips 140 to 148 on the lower display 16 including a plurality of bonus game symbols that include the plurality of credit prize symbols 84 and a mystery feature event symbol 86. In addition, the processor 38 establishes the bonus game credit meter 136 having an initial credit balance based on an amount of credits associated with credit prize symbols appearing in the outcome of the primary game, and displays the bonus game credit meter 136 on the upper display 14.

Referring to FIGS. 16A-17C, during an instance of the bonus game feature (e.g. a free spin) the processor 38 randomly selects stop positions for each of the bonus virtual reel strips 140 to 148, and spins and stops the bonus virtual reel strips 140 to 148 to display an outcome of the instance of the bonus feature game 106 including bonus game symbols displayed in each cell of the grid. The processor 38 may detect an appearance of one or more credit prize symbols 84 appearing in the outcome of the instance of the bonus feature game 106, and increase a credit balance of the bonus game credit meter 136 based on an amount of credits associated with credit prize symbols 84 appearing in the outcome of the instance of the bonus feature game 106.

The processor 38 may also detect an appearance of the mystery feature event symbol 86 in the outcome of the instance of the bonus feature game 106, and randomly determine to initiate the bonus credit prize collection event 152, the bonus meter reset event 154, or the termination feature event 156. For example, in one embodiment, upon detecting the appearance of the mystery feature event symbol 86 in the outcome of the bonus feature game 106, the processor 38 may access a feature event selection file 160 that includes a table for randomly selecting an event trigger symbol 88 for the group of symbols including the collect symbol 90, the end symbol 92, and the reset symbol 94. The feature event selection file 160 also includes a selection probability and/or a random number range associated with each event trigger symbol 88. The processor 38 randomly selects an event trigger symbol 88 from the feature event selection file 160 using random numbers generated by the RNG. Upon selecting the event trigger symbol 88, the processor 38 removes the mystery feature event symbol 86 from the displayed outcome to reveal the selected event trigger symbol 88, and initiates the feature event associated with the selected event trigger symbol 88.

For example, if the processor 38 randomly selects the collect symbol 90, the processor 38 removes the mystery feature event symbol 86 to reveal the collect symbol 90, and initiates the bonus credit prize collection event 152 (shown in FIGS. 18A-19C) including transferring a current credit balance of the bonus game credit meter 136 to the primary credit balance of the primary credit meter 110 associated with the player, and resetting the bonus game credit meter 136 to the initial credit balance for use with the next instance of the bonus feature game 106. If the processor 38 randomly selects the reset symbol 94, the processor 38 removes the mystery feature event symbol 86 to reveal the reset symbol 94, and initiates the bonus meter reset event 154 (shown in FIG. 20A-21F) to reset the bonus game credit meter 136 to the initial credit balance for use with the next instance of the bonus feature game 106. If the processor 38 randomly selects the end symbol 92, the processor 38 removes the mystery feature event symbol 86 to reveal the end symbol 92, and initiates the termination feature event 156 (shown in FIG. 22A-23C) to terminate the bonus feature game 106 and return the game screen 130 to display the primary game 102.

Figure 25:
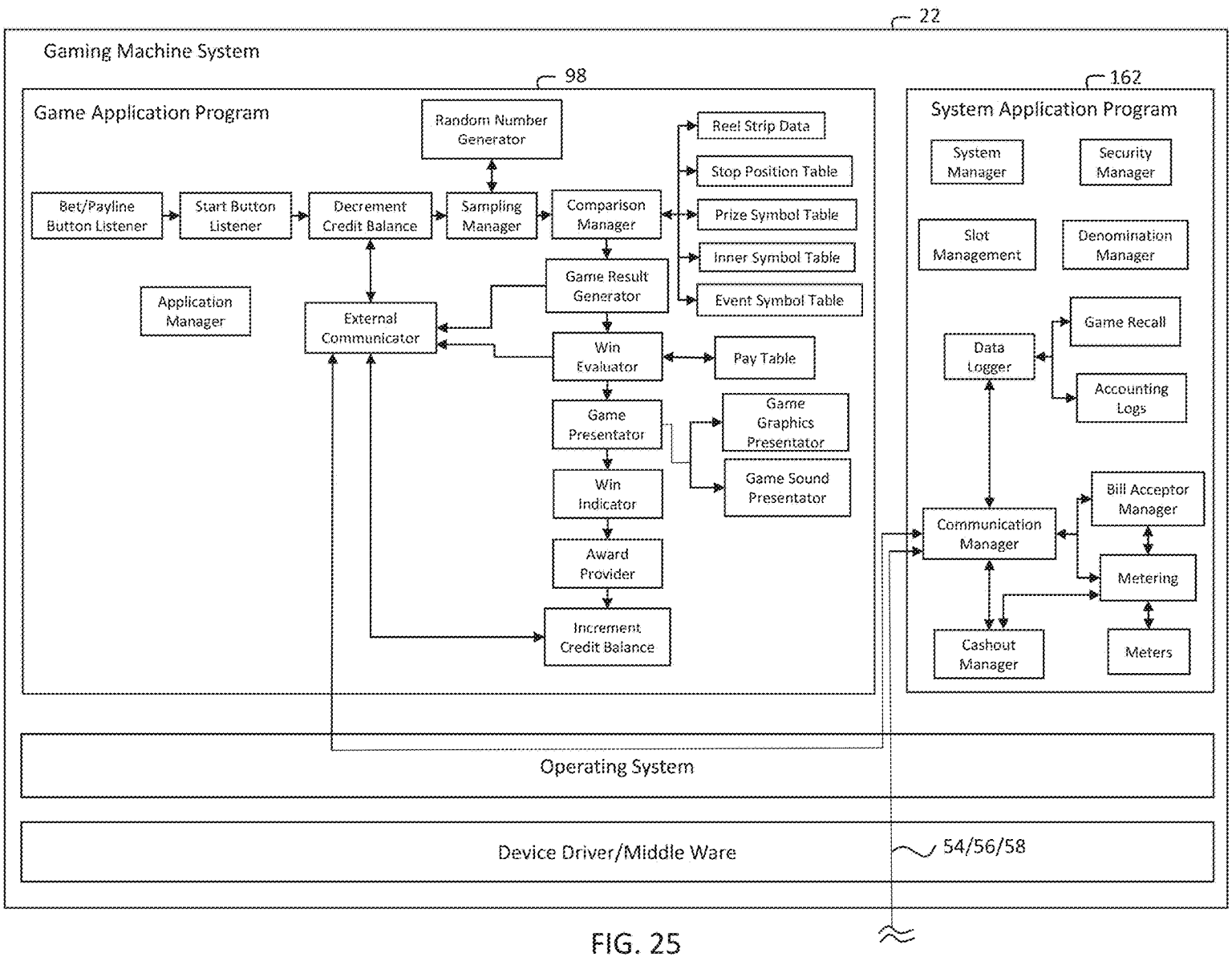
Figure 26:
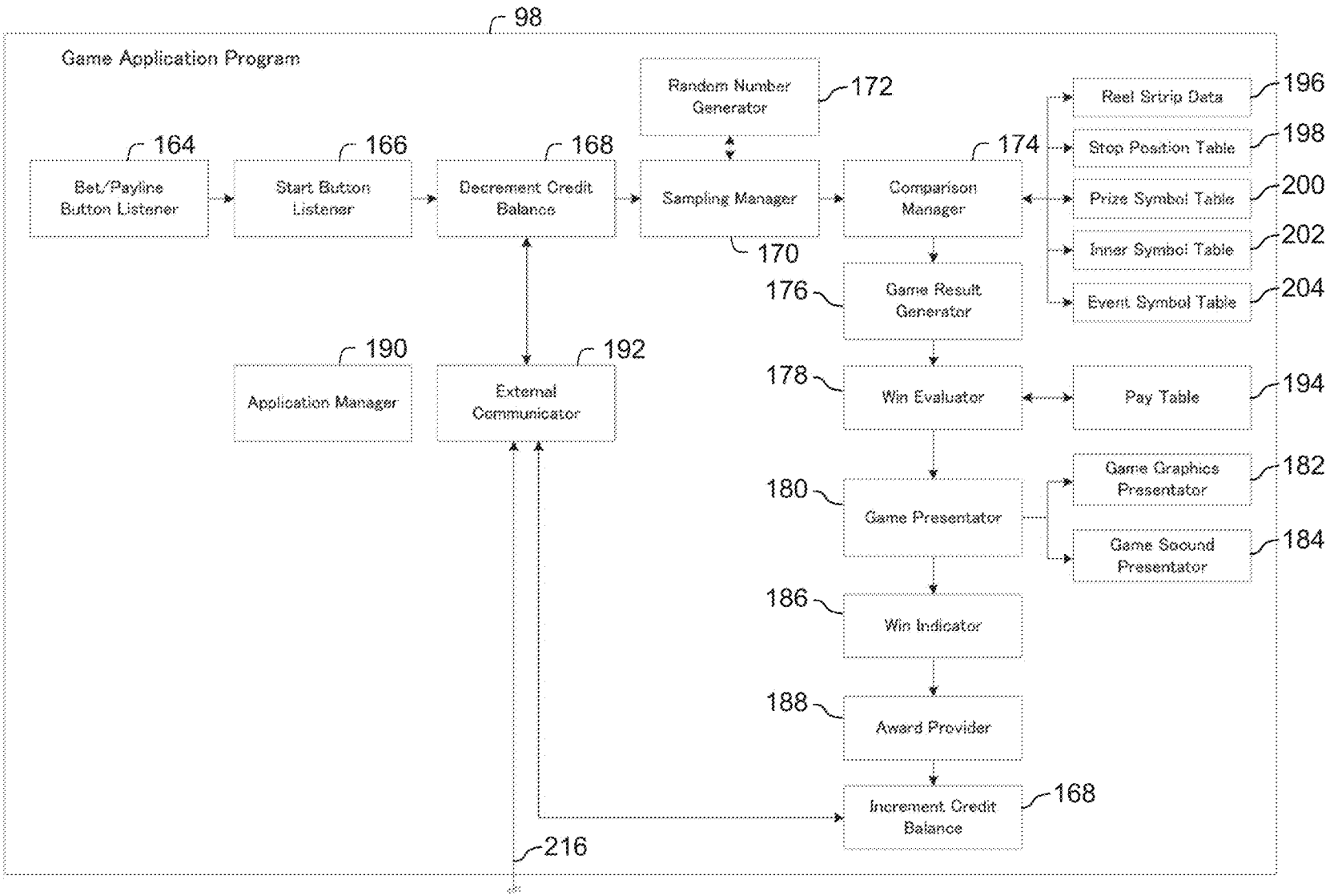
Figure 27:
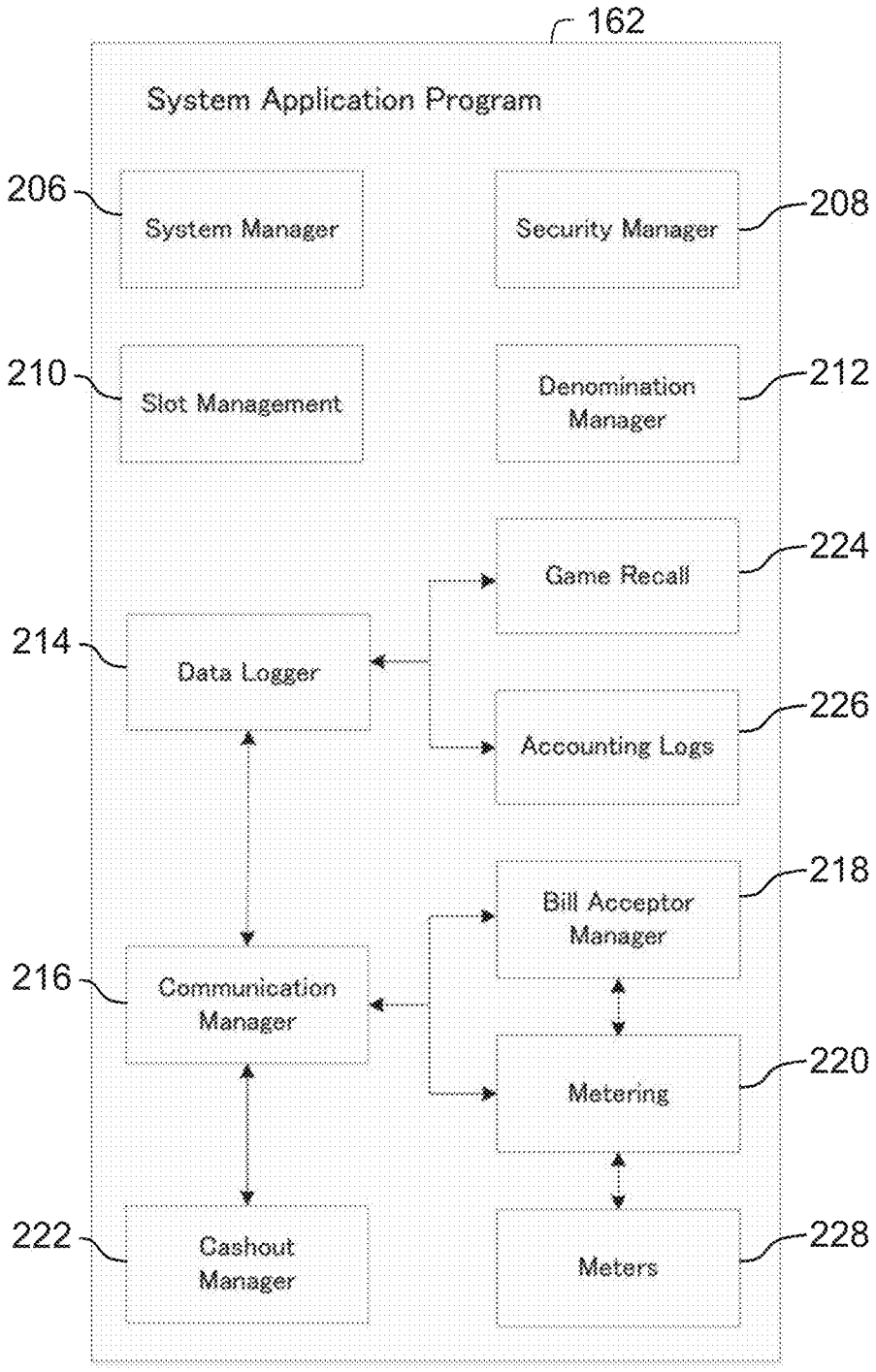

Referring to FIGS. 25-27, in the illustrated embodiment, the memory 42 stores the game application program 98 and a system application program 162 that includes computer executable instructions that, when executed by the processor 38, cause the processor 38 to generate and display the game on the display unit 24 of the gaming machine 10. The application program 98 provides game specific/front-end functions and the system application 162 program provides generic/back-end functions, when executed by the processor 38. In the illustrated embodiment, the application program 98 and the system application program 162 are implemented on the same operating system. However, it should be noted that these programs may be implemented on different operating system and/or by different processors. In one embodiment, the game application program 98 includes a plurality of software modules including a bet/payline button listener module 164, a start button listener module 166, a credit balance manager module 168, a sampling manager 170, a random number generator 172, a comparison manager 174, a game result generator 176, a win evaluator 178, a game presentator 180, a game graphics presentator 182, a game sound presentator 184, a win indicator 186, an award provider 188, an application manager 190, an external communicator 192. The game application program 98 may also include a paytable 194, a reel layout table 196, a stop position table 198, a prize symbol table 200, an inner symbol table 202, an event symbol table 204.

The bet/payline button listener module 164 is a software module for receiving a signal from the bet button or the payline button which is generated by the button when a player operates the button to select number of bet or number of paylines. In response to receiving the signal, the bet/payline button listener 164 communicates the occurrence of the signal to application manager 190 for changing bet or payline configuration of the game.

The start button listener module 166 is a software module for receiving a signal from the start button which is generated by the button when a player operates the button to start a game. In response to receiving the signal, the start button listener 166 communicates the occurrence of the signal to application manager 190 for starting the game.

In response to receiving the signal from start button listener 166, the application manager 190 requests the sampling manager 170 to obtain necessary number of random numbers form the random number generator 172.

The random number generator 172 generates random numbers based on predetermined algorithm of computational random generation method. The random number generator 172 may be a pseudorandom generator. In response to a request from sampling manager 170, the random number generator 172 returns random number. In some implementations, the random number generator 172 may be implemented in a central server. The random number generator 172 may be implemented as an integrated circuit or hard wired logic.

The comparison manager 174 compares the current state of the game or each random number with the reel layout table 196, the stop position table 198, the prize symbol table 200, the inner symbol table 202 and/or the event symbol table 204 and specifies corresponding reel layout, stop position, prize symbol, inner symbol or event symbol based on each random number.

The reel layout table 196 includes a set of virtual reels strips for Primary Game and a set of virtual reel strips for Free Game Bonus. The comparison manager 174 inquires the application manager to identify current state of the game and select one of the sets of virtual reel strips. The reel layout table 196 may include, for example, reel strip data files 114.

The stop position table 198 includes a random number range associated with each stop position of a virtual reel strip. The comparison manager 174 identify a stop position of each reel based on corresponding random number and the stop position table 198. The stop position table 198 may include, for example, stop position 126.

The prize symbol table 200 includes a random number range associated with each value of prize symbol. The comparison manager 174 identify a value of each prize symbol based on corresponding random number and the prize symbol table 200. The prize symbol table 200 may include, for example, credit prize symbol selection file 120.

The inner symbol table 202 includes a random number range associated with each stop position of a virtual inner reel. The comparison manager 174 identifies a stop position of the virtual inner reel based on corresponding random number and the inner symbol table 202. The inner symbol table 202 may include, for example, varying symbol selection file 118.

The event symbol table 204 includes a random number range associated with each event symbol. The comparison manager 174 identifies an event symbol that is a substance of the mystery feature event symbol based on corresponding random number and the event symbol table 204. The event symbol table 204 may include, for example, feature event selection file 160.

The game result generator 176 generates game result based on selected reel layout, stop positions of each reel, value of each credit symbol, stop position of inner symbol and event symbol that is a substance of the mystery feature event symbol.

The win evaluator 178 evaluates the game result with reference to the pay table, the trigger condition of the bonus free game and the payment condition of prize symbol.

The game presentator 180 provides game presentation process with visual and sound so as to form the predetermined game result finally.

The game graphics presentator 182 provides visual game presentation process on the display so as to form the predetermined game result finally.

The game sound presentator 184 provides sound presentation process by using sound controller and speakers.

The win indicator 186 indicates win combinations, trigger condition of the bonus free game and payment condition of prize symbol formed in the game result.

The award provider 188 provides award credit to win meter based on the win evaluation.

The application manager 190 administrates activity and status of each software module. In addition, the application manager 190 administrates configuration, progress and states of the game application program 98.

The external communicator 192 communicates instruction and data with the system application program 162.

The credit balance manager module 168 executes a process for decrementing credit balance and incrementing credit balance based on win amount displayed in win meter.

The paytable 194 includes a prize associated with each win combination.

In the illustrated embodiment, the system application program 162 provides back ground processing and functions other than game specific functions. The system application program 162 includes a plurality of software modules including a system manager 206, a security manager 208, a slot management module 210, a denomination manager 212, a data logger 214, a communications manager 216, a bill acceptor manager 218, a metering module 220, and a cashout manager 222.

The system application program 162 may also include a game recall file 224, accounting logs 226, and meters 228.

The system manager 206 is a software module for administrating all of the back ground processing and functions other than game specific functions conducted by the system application program 162.

The security manager 208 is a software module for administrating game verification, door security and monitoring security sensors.

The slot management module 210 is a software module for administrating data accumulation and communicating with external slot information system 58.

The denomination manager 212 is a software module for establishing denomination setting of the gaming machine 10. The denomination setting may include 1 cent, 2 cent, 5 cent, 25 cent, 1 dollar, 5 dollar and the like.

The data logger 214 is a software module for logging result of each primary game 102 and the free game bonus 106 to the game recall. In addition, the data logger 214 stores error events, bill log, cashout log, ticket log etc. to the accounting log.

The game recall file 224 is an accumulated data including results of each primary game 102 and free game bonus 106. The game recall file 224 is stored in a non-volatile memory.

The accounting logs 226 is an accumulated data including error events, bill log, cashout log, ticket log etc. The accounting logs 226 are stored in a non-volatile memory.

The communications manager 216 is a software module for administrating communication between game application program 98 and game system program 162. The communications manager 216 also administrates network communication between game system program 162 and external network such as slot management system network, G2S network, gaming server for server based gaming network or VLT system network.

The bill acceptor manager 218 is a software module for administrating the bill acceptor and receives bill information inserted in the bill acceptor. In response to receiving the information from the bill acceptor, the bill acceptor manager 218 communicates with the metering for incrementing credit balance based on the inserted bill.

The metering module 220 is a software module for adjusting values of the meters 228 in response to communication with the game application program 98 via communications manager 216, the bill acceptor manager 218 or the cashout manager 222. The meters 228 includes a credit meter for indicating current credit balance on the gaming machine and an win meter for indicating win amount of current game session. The meters further include back ground meters such as coin-in, coin-out, total drop, attendant paid jackpots and/or bill-in. These meters might be implemented as data on the non-volatile memory or hardware meters.

The cashout manager 222 is a software module for administrating cashout procedure. In response to a player's operation on the cashout button, the cashout manager 222 is activated and the gaming machine pay total amount of the credit meter.

Figure 7:
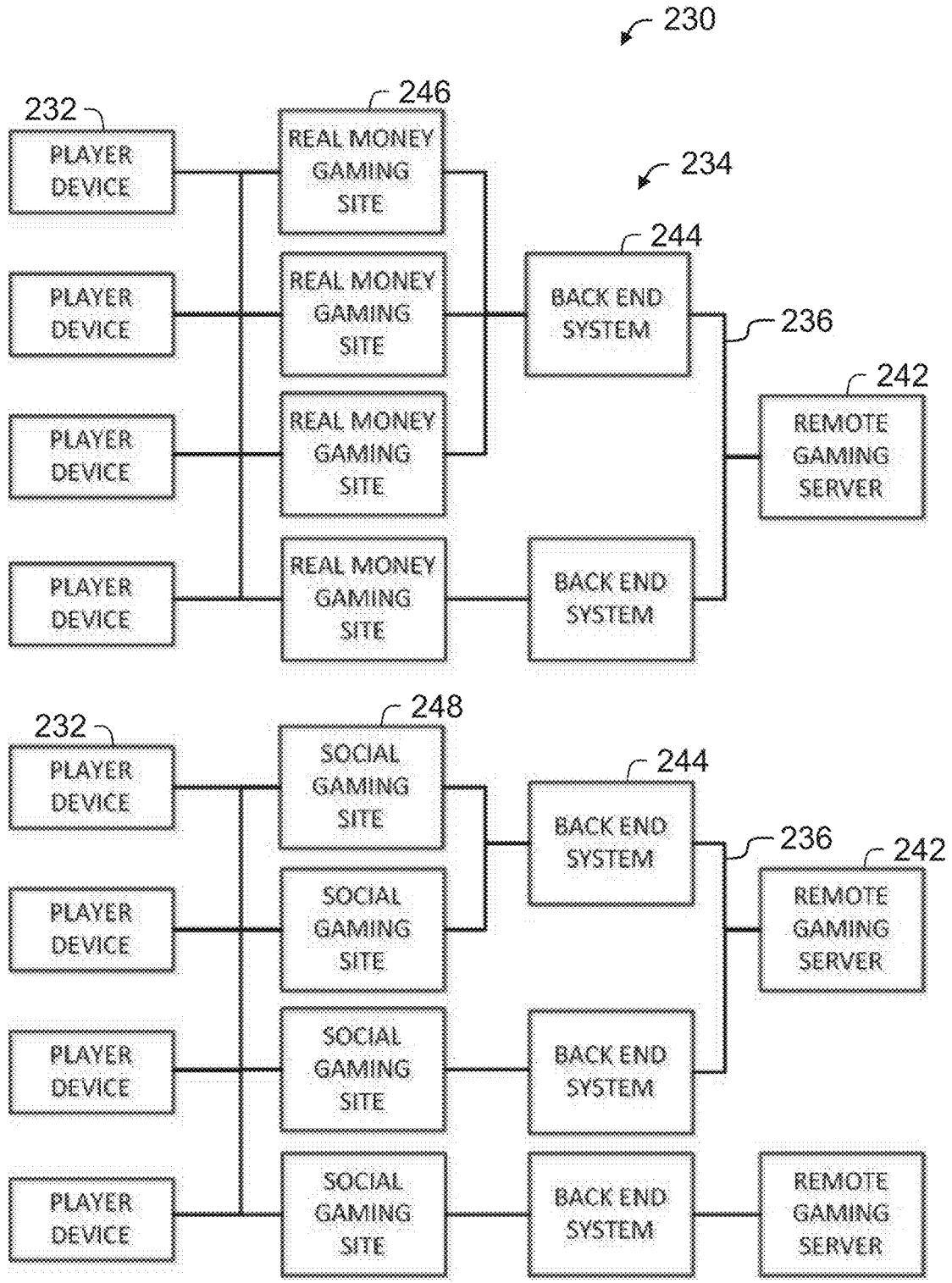
FIG. 7 is a functional block diagram of a server computer system, according to an embodiment of the present invention.
Figure 8:
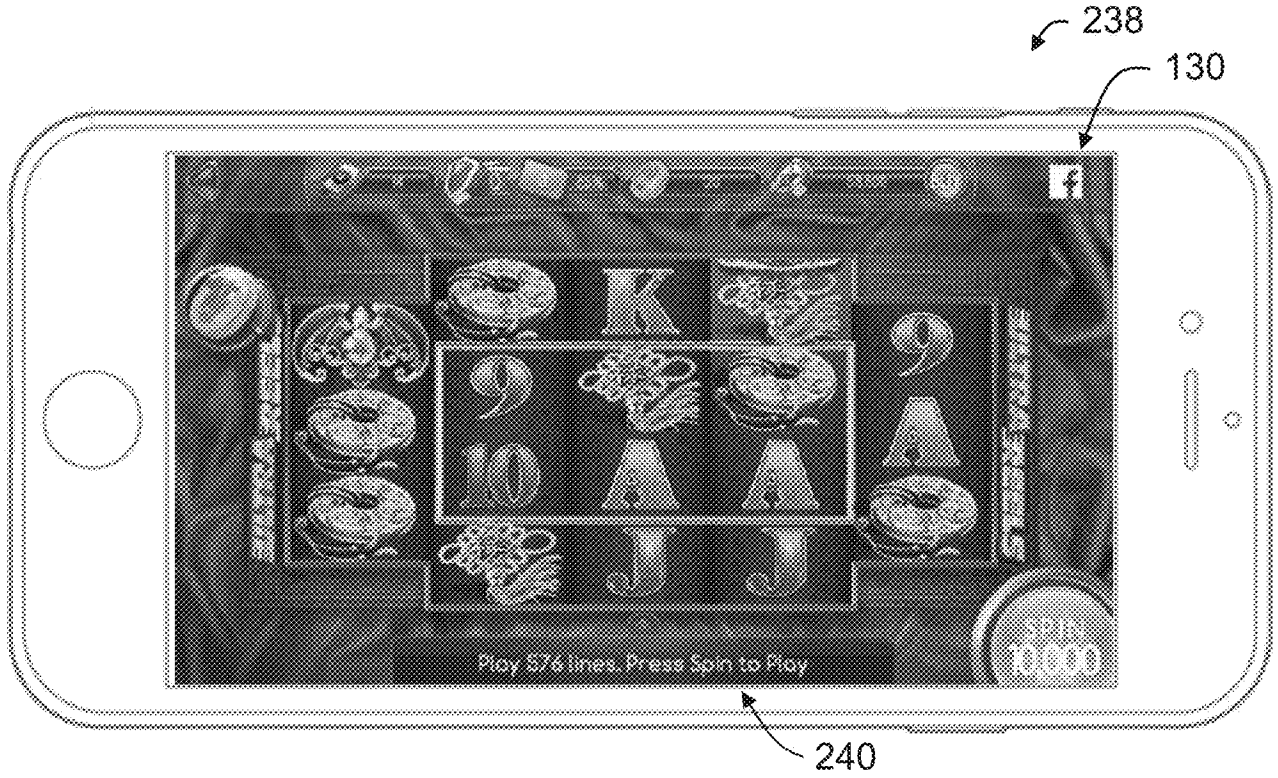
FIG. 8 is a front view of a mobile computing device that may be used with the server computer system of FIG. 7.

Referring to FIGS. 7 and 8, in one embodiment, the present inventions includes an networked server computer system 230 that is configured to deliver the game to one or more client computing devices 232 over the Internet. In the illustrated embodiment, the networked computer system 230 includes an iGaming server system 234 that is coupled in communication with one or more client computing devices 232 via a communications network 236. The communications network 236 may be any suitable connection, including the Internet, an Intranet, LAN, a virtual private network (VPN), cellular networks, etc. . . . , and may utilize any suitable or combination of technologies including, but not limited to wired and wireless connections, always on connections, connections made periodically, and connections made as needed.

The client computing device 232 may include any suitable device that enables a user to access and communicate with the server system 234 including sending and/or receiving information to and from the server system 234 and displaying information received from the server system 234 to a user. In the illustrated embodiment, the client computing device 232 includes a processor coupled to a memory device. The memory device stores various programs and data that are executed by the processor for operating the client computing device 232. The client computing device 232 also includes an input device configured to receive operational inputs from the user, and a display device configured to display a graphical user interface. The input device and display device enable a user to interact with the server system 234 via the client computing device 232. For example, in one embodiment, the client computing device 232 may include, but is not limited to, a desktop computer, a laptop or notebook computer, a tablet computer, smartphone/tablet computer hybrid, a personal data assistant, a handheld mobile device including a cellular telephone, and the like. In one embodiment, the processor of the client computing device 232 may be programmed to function as the control unit 22 of the gaming machine 10.

In the illustrated embodiment, the client computing device may include a web browser program stored in the memory device. The processor executes the web browser program to display web pages on the display device that includes information received from the server system 234 to enable a user to interact with and operate the server system 234.

In one embodiment, the client computing device 232 includes a mobile computing device 238 (shown in FIG. 8) such as, for example, a tablet computer, a smartphone/tablet computer hybrid, a smartphone such as an iPhone™, and the like. The mobile computing device 238 includes a processor coupled to a memory device for storing various programs and data for use in operating the mobile computing device 238. The mobile computing device 238 may also include a touchscreen display unit 24, one or more video image cameras, one or more speakers 26, a microphone, at least one input button, and one or more sensors including, but not limited to, a touch ID fingerprint sensor coupled to an input button, a barometer, a three-axis gyro, an accelerometer, proximity sensor, and an ambient light sensor. In addition, the mobile computing device 238 may also include a Wi-Fi antenna, a cellular network antenna, a Bluethooth™ communications device, assisted GPS and GLONASS, a digital compass, and an iBeacon™ microlocation device.

The mobile computing device 238 may be programmed to store and execute mobile computer program applications that display graphical user interfaces 240 on the touchscreen display unit 24 that allows the user to access the server system 234 to retrieve and store information within the server system 234 as well as interact with and operate the server system 234. In addition, in one embodiment, the server system 234 may install one or more mobile computer application programs in the memory device of the mobile computing device 238. When initiated by the processor of the mobile computing device 238, the mobile computer application program causes the processor of the mobile computing device 238 to perform some or all of the functions of the gaming machine 10.

In the illustrated embodiment, the server system 234 includes one or more remote gaming servers 242, one or more back-end servers 244, one or more real money gaming website hosting servers 246, and one or more social gaming website hosting servers 248. In the illustrated embodiment, the social gaming website hosting server 248 and the real money gaming website hosting server 246 are programmed to host a website that is accessible by a user via one or more client computing devices 232. The website hosting servers 246 and 248 execute a website application program that retrieves application code from the back-end server 244 and executes the application code to render one or more webpages on a display device of a client computing device 232 in response to requests received from the user via the client computing device 232 to allow users to interact with the website. The website hosting servers 246 and 248 are configured to generate and display webpages displaying the game screen 130 including the primary game 102 and the bonus feature game 106. For example, the real money gaming website hosting server 246 is configured to host a real money wagering website that enables players to convert monetary funds to gaming credits that may be used to place wagers on the game. The social gaming website hosting server 248 is configure to host a social media and/or social gaming website that allows players to receive gaming credits for activities such as purchasing goods and/or services through an e-commerce website, and/or purchase gaming credits that may be used to play the game.

Each back-end server 244 is configured to perform operations to support the functions of the webpages and/or website being displayed by the website hosting servers 246 and 248. For example, in one embodiment, the back-end servers 244 may include a player account system server that is configured to generate player accounts that include data associated with a player including, but not limited to, player identification information, player financial account information, player gaming credit account information, and/or any suitable player information, that may be used to establish credit meters and allow players to place wagers on the primary game 102.

Each remote gaming server 242 includes one or more copies of the game application program 98 stored in a memory device of the remote gaming server 242. A processor of the remote gaming server 242 is programmed to retrieve and transmit the game application program 98 to one or more back-end servers 244 for use in displaying the game to the user via a webpage being displayed by the web browser program.

In one embodiment, the game application program 98 may include instructions for rendering the game and executing the primary game 102 and the bonus feature game 106 on the client computing device 232. For example, the game application program 98 may include instructions for generating rendered code, such as, for example HTML code, that may be used by the web browser program of the client computing device 232 for displaying the game. For example, the game application program 98 may include program software code including, but not limited to, HTML, JavaScript, cascade style sheets (CSS), and any suitable programming code that may be used for rendering and operating the game via a website and/or mobile computer application.

In one embodiment, upon receiving a request from the website hosting servers 246, 248 via the back-end server 244, the remote gaming server 242 may execute the game application program 98 to operate the game, and execute a render-to-string operation to generate rendered code indicative of the game, such as, for example HTML code, and transmit the rendered code to the back-end server 244. The back-end server 244 may then transmit the rendered code to the corresponding website hosting servers 246, 248 for use in displaying the game on the website. As the player plays the game, the remote gaming server 242 may execute the game application program 98 for each instance of the game, and transit rendered code to the back-end servers 244.

In another embodiment, the remote gaming server 242 may transmit the game application program 98 to the back-end server 244 and/or the website hosting servers 246, 248. The back-end server 244 and/or the website hosting servers 246, 248 may then execute the game application program 98 to initiate the instances of the game and execute render-to-string operations to generate rendered code indicative of the game.

In yet another embodiment, the back-end server 244 may receive a request to initiate the game from a mobile computing device 238 executing the mobile computer application program. Upon receiving the request, the back-end server 244 may access the game application program 98 and execute a render-to-string operation to generate rendered code indicative of the game and transmit the rendered code to the mobile computing device 238. In one embodiment, the back-end server 244 may continuously execute the game application program 98 to generated each instance of the game using a random number generator of the back-end server 244 based on input received from the mobile computing device 238 and generate and transmit rendered code for each instance of the game to the mobile computing device 238. In another embodiment, the back-end server 244 may execute a partial-render operation and generate partially-rendered code of the game using the game application program 98, and transmit the partially rendered code of the game and object data of game assets to the mobile computing device 238. The partially rendered code includes instructions for generating rendered code using the game assets and a random number generator of the mobile computing device for generating and displaying the game on the mobile computing device 238 using the mobile computer application program.

In one embodiment, the game application program 98 may be stored on several different servers. The game code on these servers is used to distribute game content to social or real money gaming websites and mobile applications. The distribution method is very flexible. For example, the game code and/or game application program 98 including game code and game object assets may be stored on a remote gaming server 242. One remote gaming server 242 may be connected to one or more back-end server 244.

Each back-end server 244 is configured to distribute the games to one or more websites or mobile applications. Players connect to these websites/mobile applications with the client devices or mobile devices and have access to the game content. A copy of game application program 98 including game code and game object assets is stored on the remote gaming server 242 for each back-end server 244 that is connected to the remote gaming server 242 and that distributes the game. For example, if one remote gaming server 242 is connected to two back-end servers 244, which is connected to three website hosting servers 246, 248 that distribute the game, the remote gaming server 242 would store two copies of the game application program 98 including game code and game object assets for the game (e.g. one copy for each back-end server 244).

For example, the server system 234 may be configured to implement the game on a mobile application such as, for example, "my KONAMI Slots™" mobile application available in Apple iOS™, Google Android™, and Amazon Kindle™ operating platforms, or on social-media websites such as the "my KONAMI Slots™" available on Facebook™. In one embodiment, the mobile application may download the game code from remote gaming server 242 via the real money gaming site 246 or the social gaming site 248 and execute the game code on the client computing device 232. In this embodiment, the game code may provide game specific/front-end function when executed by the processor of the client computing device, and the back end system 234 may provide generic/back-end function.

FIGS. 9-11 are flowcharts of methods 300, 400, and 500 that may be used for operating the gaming machine 10 and/or iGaming server system 234 to implement the game on a client device. The methods include a plurality of steps. Each method step may be performed independently of, or in combination with, other method steps. Portions of the methods may be performed by any one of, or any combination of, the components of the gaming machine 10 and/or iGaming server system 234. FIGS. 12A-23C are exemplary illustrations of game sequences that may be displayed during the game.

Referring to FIG. 9, in the illustrated embodiment, in method step 302, the processor 38 displays the primary game 102 including the plurality of virtual reel strips 66 to 74 on the lower display 16, and receives a signal from the operation unit 32 indicating a wager being made by the player. For example, in one embodiment, the player may depress a bet button that causes a signal to be sent form the operation unit 32 to the processor 38 indicating a wager being placed by the player.

Figures 12A, 12B, 12C, 12D:
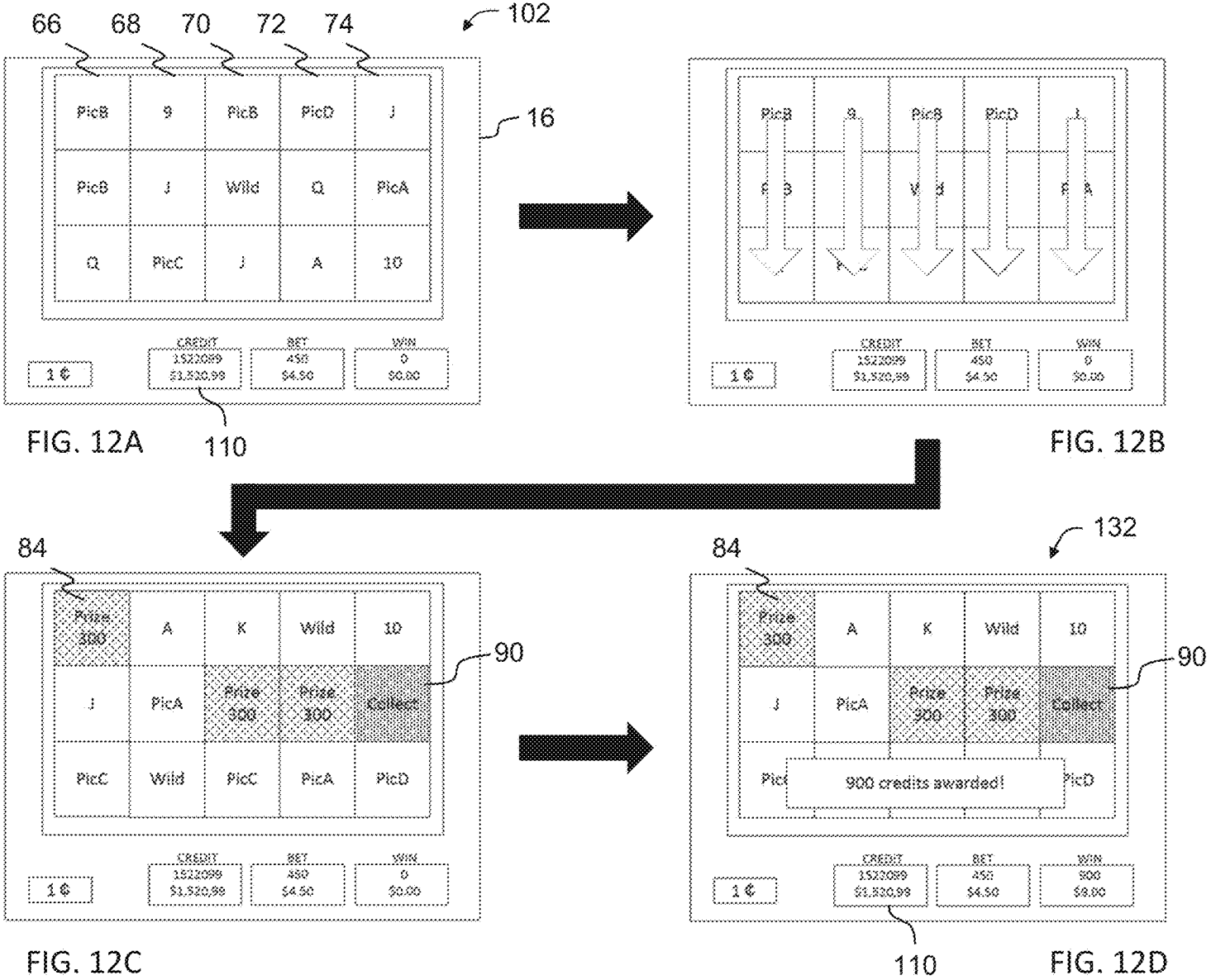
FIGS. 12A-12D are diagrammatic illustrations of a game being displayed on the display area of the gaming machine in FIGS. 1A-2, according to an embodiment of the present invention.

In method step 304, upon receiving a signal indication a wager being placed by the player, the processor 38 randomly determines an outcome of an instance of the primary game 102 and spins the virtual reel strips 66 to 74 (as shown in FIGS. 12B and 13B) and sequentially stops the virtual reel strips 66 to 74 (shown in FIGS. 12C and 13C) to display the randomly generated outcome including a game symbol being displayed in each cell 64 of the grid 62. For example, in one embodiment, the processor 38 may execute the algorithm 400 shown in FIG. 10, including receiving a signal indicating the player depressing the spin button and start spinning each virtual reel strip 66 to 74, obtain random numbers from the random number generator, and determine a stop position of each virtual reel strip 66 to 74 based on the random numbers and the stop position data file 131. In one embodiment, the processor may obtain a random number for each simulate virtual reel strip 66 to 74, i.e. five random numbers. The processor 38 then established a reel stop counter, "i", and sets the reel stop counter, i, equal to 1. The processor 38 then identifies the $i^{th}$ virtual reel strip associated with the stop counter, i, and stops the identified virtual reel strip to display the corresponding symbols in the corresponding cells 64 associated with the identified virtual reel strip. The processor then increments the reel stop counter, i, by 1, i.e. i=i+1, and repeats the process of identifying the virtual reel strip associated with the incremented reel stop counter and stopping the identified virtual reel strip. This process continues until each virtual reel strip has been stopped. In this embodiment, for example, the virtual reel strips are numbered 1-5. In one embodiment, during the reel spin, the player may initiate the stopping of the reels by depressing the spin button, which enables the player to accelerate game play.

In one embodiment, upon receiving a signal indicating the player depressing the spin button, the processor may generate each virtual reel strip 66 to 74 for use during the instance of the primary game 102. For example, in one embodiment, the processor 38 may execute the game application program 98 using the primary game reel strip data file 128 for use in generating each virtual reel 66 to 74. The processor 38 may accesses the primary game reel strip data file 128 and identify a reel designation 124 associated with the virtual reel being generated, and access each sequential symbol position logic cell 122 for generating and displaying the corresponding game symbols. The processor 38 then generates the corresponding virtual reel strip based on the instructions associated with each sequential symbol position logic cell 122, associated with the reel designation 124. For example, for each logic cell 122 indicating a credit prize symbol 84 ("Prize"), the processor 38 randomly selects a credit prize symbol 84 based on the credit prize symbol selection file 120 (shown in FIG. 32), and populates the corresponding symbol position on the reel strip with the randomly selected credit prize symbol 84. Each "Prize" logic cell is transformed into a value chosen from 10, 15, 20, 30, 60, 150, 350, 700, 1000, 1500 and 3000 in each game. In addition, the processor 38 accesses the symbol selection data files 116 to randomly select a symbol that is populated in symbol position designating a varying symbol ("inn"). Each "inn" logic cell is transformed into PicA, PicB, PicC, PicD, A, K, Q, J, 10 or 9 in each game, such that each "inn" logic cell is populated with the same symbol.

In one embodiment, the processor 38 generates the virtual reel strips 66 to 74 including plurality of credit prize symbols 84 indicating various credit amounts, and a collect symbol 90 indicating an award of credits. For example, the processor 38 may generate the $5^{th}$ virtual reel strip 74 to include the collect symbol 90.

In method step 306, upon stopping the virtual reel strips 66 to 74, the processor 38 executes the algorithm 400 shown in FIG. 10 and determines if any winning combination of symbols is displayed in the outcome if the instance of the primary game 102, and determines an initial award associated with the winning outcome. In one embodiment, the processor 38 detects an appearance of a winning combination of game symbols in the outcome based on the paylines shown in FIG. 6, and provides an initial award based on the winning combination of symbols and a paytable.

In method step 308, the processor 38 executes the algorithm 400 shown in FIG. 10 and detects an appearance of the collect symbol 90 and at least one credit prize symbol 84 in the outcome of the instance of the primary game 102 (shown in FIGS. 12D and 13D). Upon detecting the appearance of the collect symbol 90 and at least one credit prize symbol 84 in the outcome of the primary game 102, the processor determines an amount of credits associated with the credit prize symbol 84 appearing in the outcome and provide a bonus award including the determined amount of credits associated with the credit prize symbols 84. For example, as shown in FIGS. 12D and 13D, the processor calculates a sum of the credit amounts being displayed by each credit prize symbol 84 and pays an award equal to the sum of credits to the player. As shown in FIG. 12D, the outcome of the primary game 102 includes three credit prize symbols 84 and the collect symbol 90 displayed, so the total value of three prize symbols is awarded. The processor 38 then adjusts a credit balance of the primary credit meter 110 associated with the player based on the amount of the initial award and the amount of the bonus award.

Figures 14A, 14B, 14C, 14D:
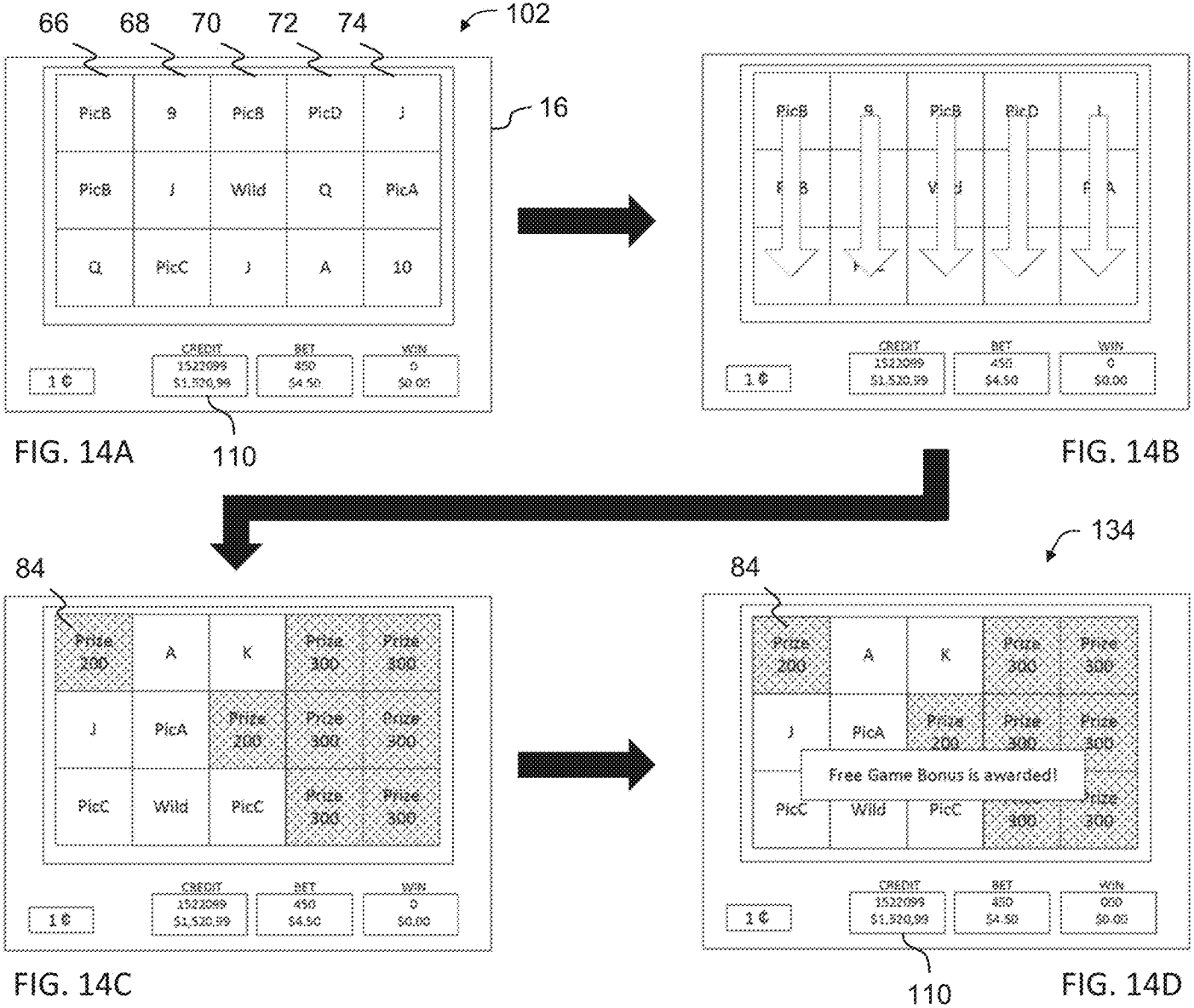
FIGS. 14A-14D are diagrammatic illustrations of a triggering event occurring during the game being displayed on the display area of the gaming machine in FIGS. 1A-2, according to an embodiment of the present invention.
Figures 15A, 15B, 15C, 15D:
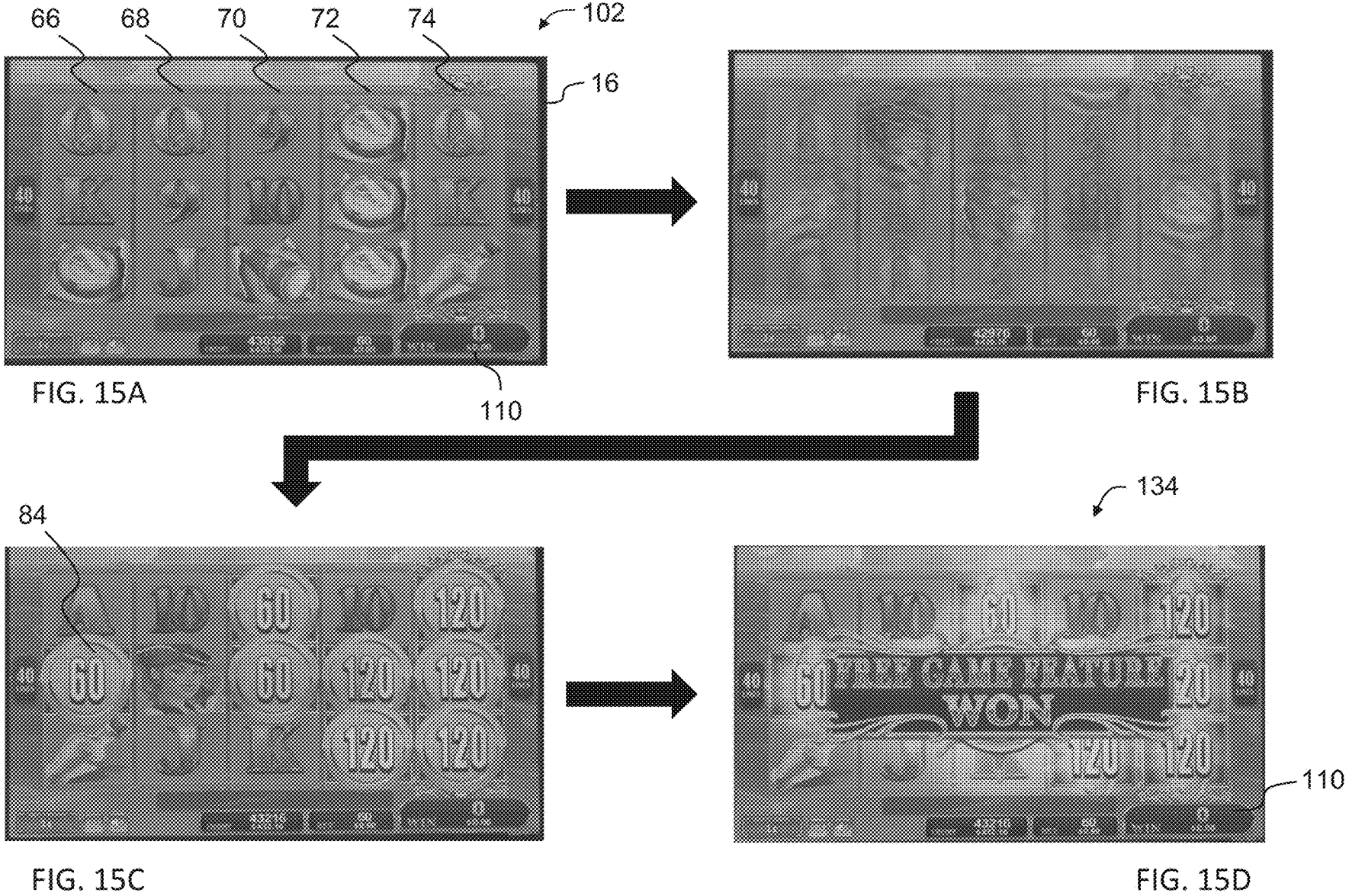
FIGS. 15A-15D are illustrations of a sequence of graphic images that may be used to display the triggering event shown in FIGS. 14A-14D, according to an embodiment of the present invention.

In method step 310, the processor 38 is programmed to detect a triggering condition occurring during the primary game 102 and initiate the bonus feature game 106 including a number of free spins. For example, in one embodiment, as shown in FIG. 14A-15D, the processor 38 may be programmed to detect the triggering condition upon detecting the appearance of a predefined number of credit prize symbols 84 appearing in the outcome of the primary game 102. As shown in FIGS. 14D and 15D, eight credit prize symbols 84 are displayed, so the Free Game Bonus (e.g. bonus feature game) is awarded. In the illustrated embodiment, upon detecting the triggering condition occurring during the primary game 102, the processor 38 executes the algorithm 500 shown in FIG. 11 to implement the bonus feature game 106.

Figures 16A, 16B, 16C:
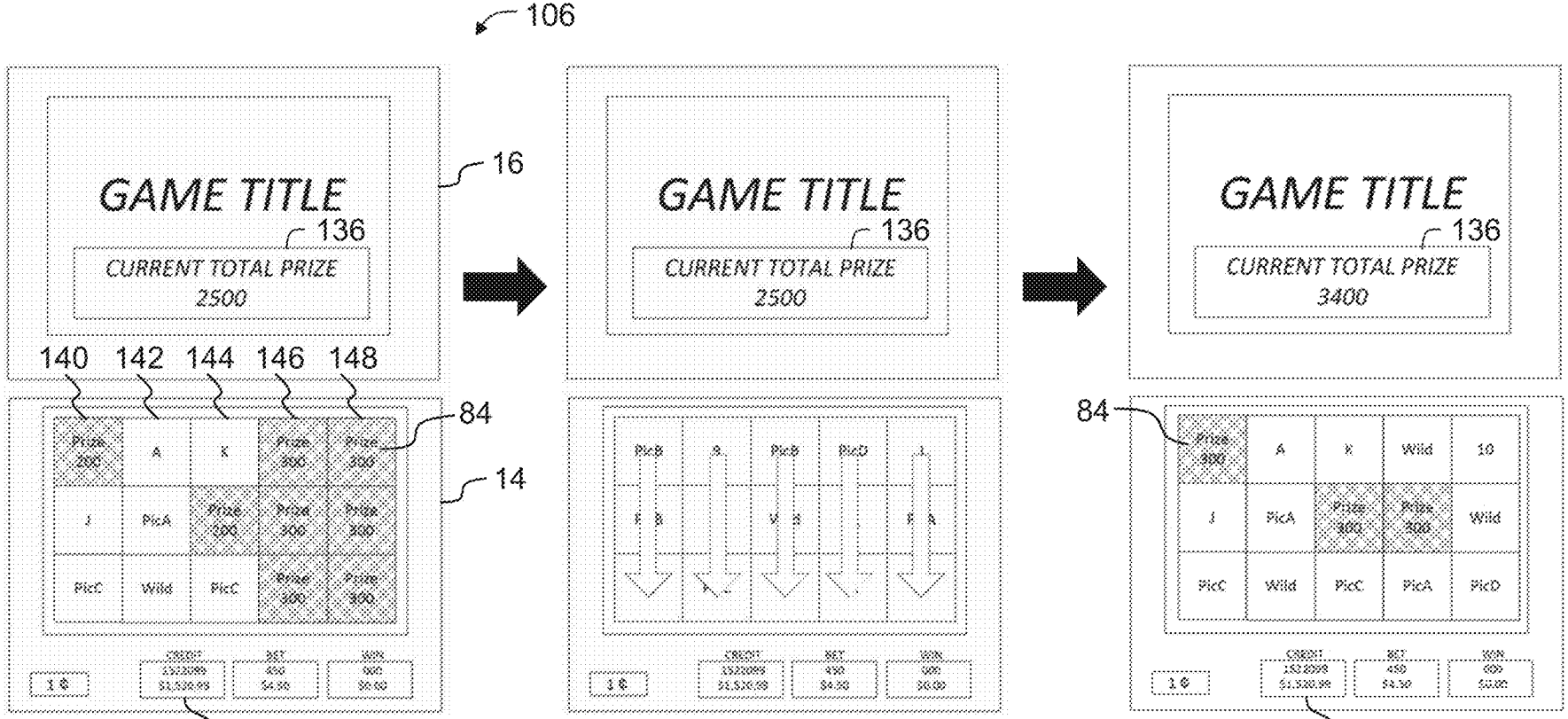
FIGS. 16A-16C are diagrammatic illustrations of a bonus feature game being displayed on the display area of the gaming machine in FIGS. 1A-2, according to an embodiment of the present invention.
Figure 17C:
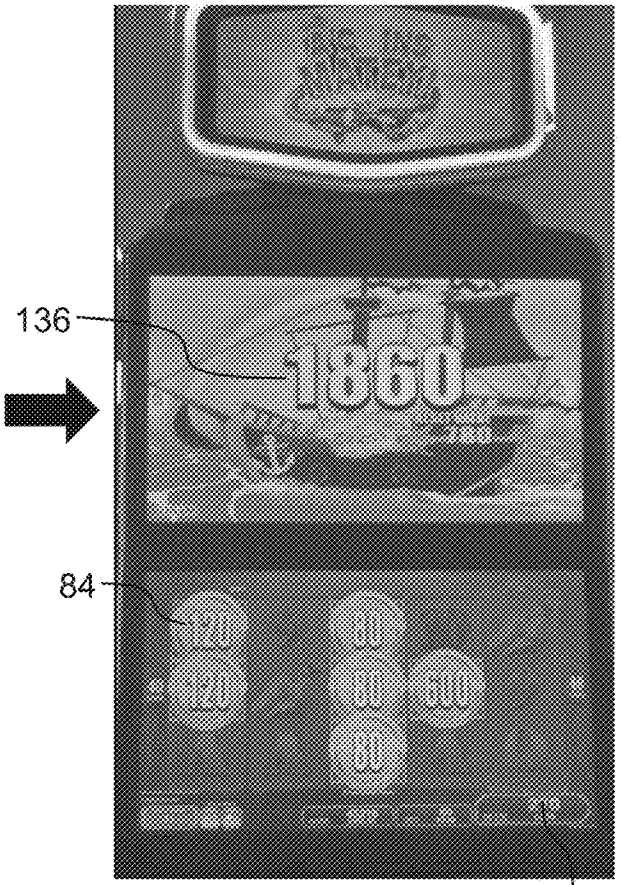
FIGS. 17A-17C are illustrations of a sequence of graphic images that may be used to display the bonus feature game shown in FIGS. 16A-16C, according to an embodiment of the present invention.
Figure 17B:
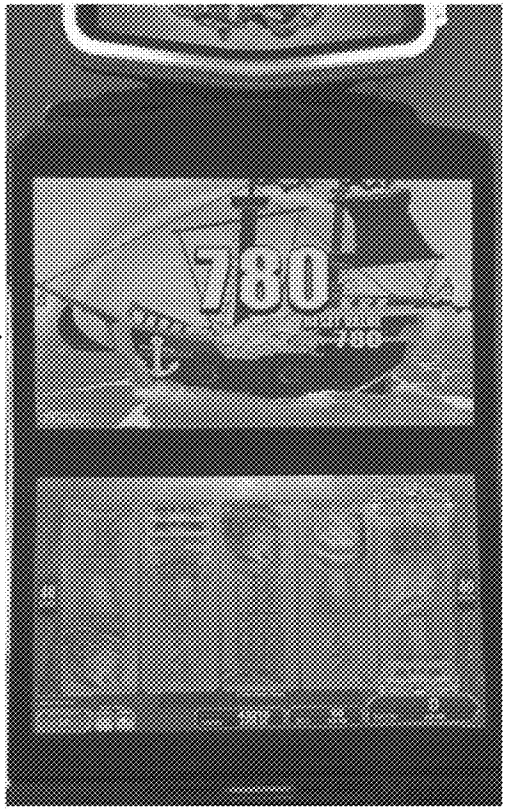
Figure 17A:
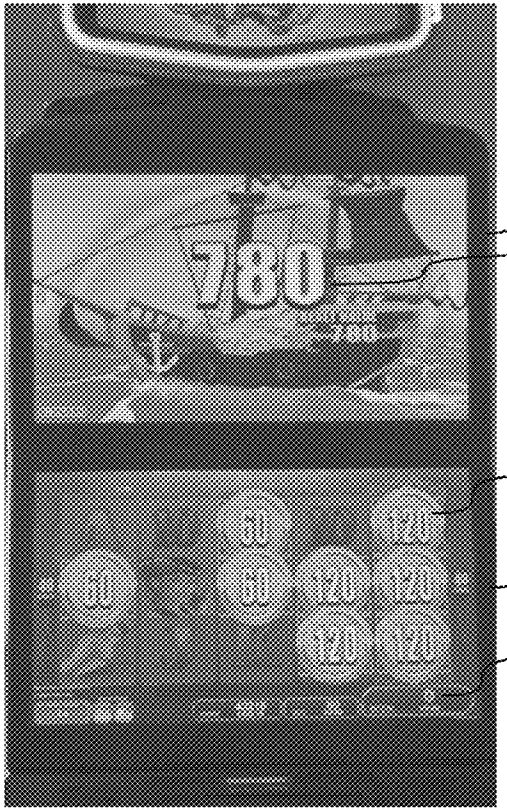
Figure 18C:
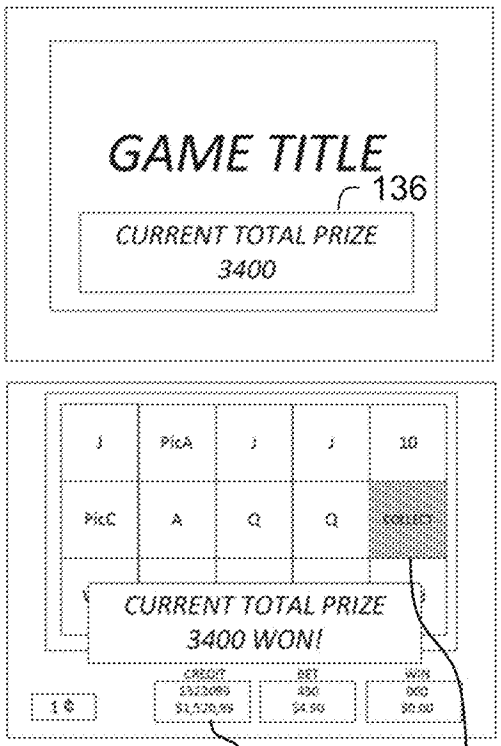
FIGS. 18A-18C are diagrammatic illustrations of the bonus feature game being displayed on the display area of the gaming machine in FIGS. 1A-2, according to an embodiment of the present invention.
Figure 18B:
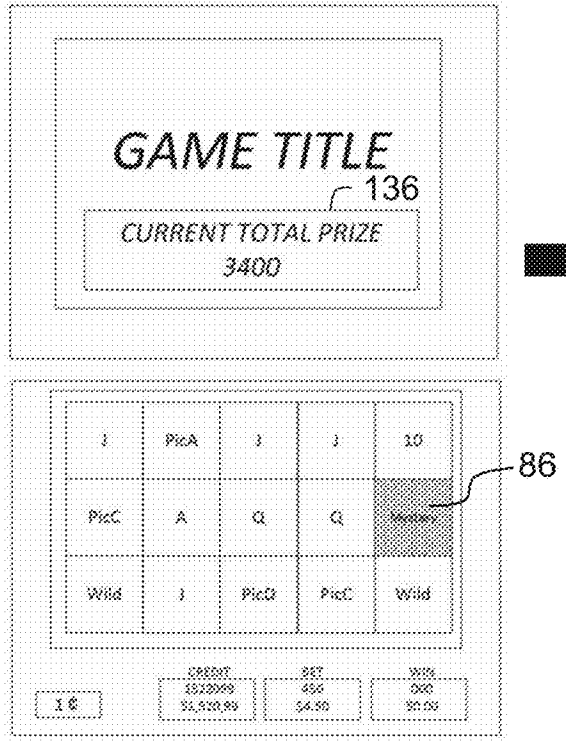
Figure 18A:
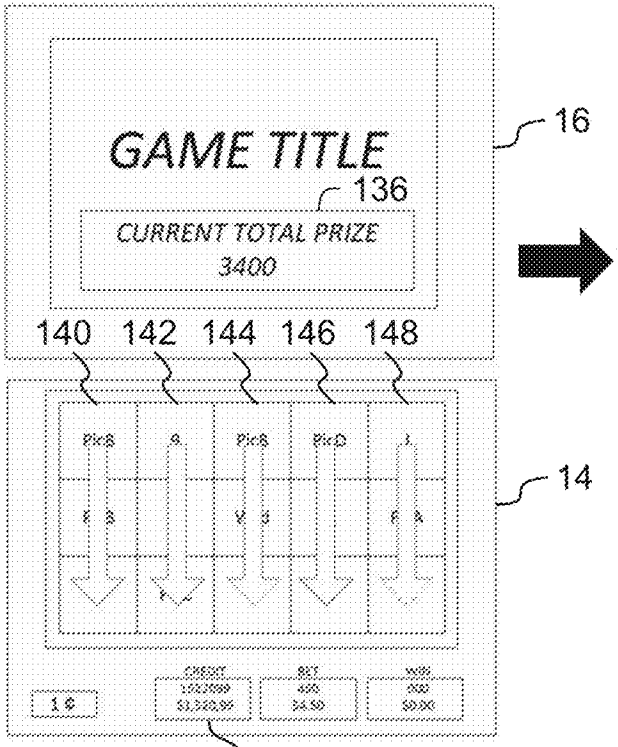

With reference to FIG. 11, the processor 38 is programmed to determine the total value of the amount of credits associated with credit prize symbols 84 appearing in the outcome of the primary game 102, and establish a bonus game credit meter 136 for use during the bonus feature game 106. The bonus game credit meter 136 is established with an initial credit balance based on the total value of the amount of credits associated with credit prize symbols 84. As shown in FIGS. 16A and 17A, the processor 38 displays the bonus game credit meter 136 on the game screen 130. In one embodiment, the processor 38 displays an animated pirate ship on the upper display 14 along with the bonus game credit meter 136.

The processor 38 initiates the bonus feature game 106 by generating the bonus virtual reel strips 140 to 148 for use during the bonus feature game 106. In one embodiment, the processor 38 may execute the game application program 98 using the bonus game reel strip data file 129 for use in generating each bonus virtual reel strip 140 to 148. The processor 38 may access the bonus game reel strip data file 129 and identify a reel designation 124 associated with the bonus virtual reel being generated, and access each sequential symbol position logic cell 122 for generating and displaying the corresponding game symbols. The processor 38 then generates the corresponding bonus virtual reel strip based on each sequential symbol position logic cell 122. For example, for each logic cell 122 indicating a credit prize symbol 84 ("Prize"), the processor 38 randomly selects a credit prize symbol 84 based on the credit prize symbol selection file 120 (shown in FIG. 32), and populates the corresponding symbol position on the reel strip with the randomly selected credit prize symbol 84. Each "Prize" logic cell is transformed into a value chosen from 10, 15, 20, 30, 60, 150, 350, 700, 1000, 1500 and 3000 in each game. In addition, the processor 38 accesses the symbol selection data files 116 to randomly select a symbol that is populated in symbol position designating a varying symbol ("inn"). Each "inn" logic cell is transformed into PicA, PicB, PicC, PicD, A, K, Q, J, 10 or 9 in each game, such that each "inn" logic cell is populated with the same symbol. The processor 38 also generates the bonus virtual reel strips 140 to 148 including the mystery feature event symbol 86 indicating an occurrence of a feature event. In the illustrated embodiment, the processor 38 generates the $5^{th}$ bonus virtual reel 148 to include a plurality of mystery feature event symbol 86.

Referring to FIG. 11, the processor 38 prompts the player to initiate an instance of the bonus feature game 106 by depressing the spin button. Upon receiving a signal indicate that the spin button has been depressed, the processor starts spinning each bonus virtual reel strip 140 to 148 and obtains random numbers from the random number generator. The processor 38 then determines a stop position of each bonus virtual reel strip 140 to 148 based on the random numbers and the stop position data file 131. The processor 38 then established a reel stop counter, "i", and sets the reel stop counter, i, equal to 1. The processor 38 then identifies the $i^{th}$ virtual reel strip associated with the stop counter, i, and stops the identified bonus virtual reel strip to display the corresponding symbols in the corresponding cells 64 associated with the identified bonus virtual reel strip. The processor then increments the reel stop counter, i, by 1, i.e. i=i+1, and repeats the process of identifying the virtual reel strip associated with the incremented reel stop counter and stopping the identified virtual reel strip. This process continues until each bonus virtual reel strip has been stopped. In this embodiment, for example, the bonus virtual reel strips are numbered 1-5. In one embodiment, during the reel spin, the player may initiate the stopping of the reel strips by depressing the spin button, which enables the player to accelerate game play.

For example, as shown in FIG. 16A-17D, the processor 38 initiates an instance of the bonus feature game including executing the game execution program to generate and display the plurality of bonus virtual reel strips on the game screen, and randomly select stop positions for each of the bonus virtual reel strips. The processor 38 may then spin and stop the bonus virtual reel strips to display an outcome of the instance of the bonus feature game including bonus game symbols displayed in each cell of the grid.

The processor 38 then evaluates the outcome of the instance of the bonus feature game 106 and determines whether one or more credit prize symbols 84 appear in the outcome. As shown in FIGS. 16C, and 17C, upon detecting an appearance of one or more credit prize symbols appearing in the outcome of the instance of the bonus feature game, the processor 38 increases a credit balance of the bonus credit meter 136 based on an amount of credits associated with credit prize symbols 84 appearing in the outcome of the instance of the bonus feature game 106. For example, the processor 38 determines the values of credits being displayed by the credit prize symbols 84 and adds the determined value to the total value displayed in the bonus credit meter 136. As shown in FIG. 17C, as the credit balance of the bonus credit meter 136 is increased, the processor 38 may also display the initial credit balance as a reset balance.

The processor 38 then determines whether a mystery feature event symbol 86 appears in the outcome. If a mystery feature event symbol 86 does not appear in the outcome, the processor 38 initiates another instance of the bonus feature game 106 and initiates a spin of the bonus virtual reel strips 140 to 148.

Figures 19A, 19B, 19C:
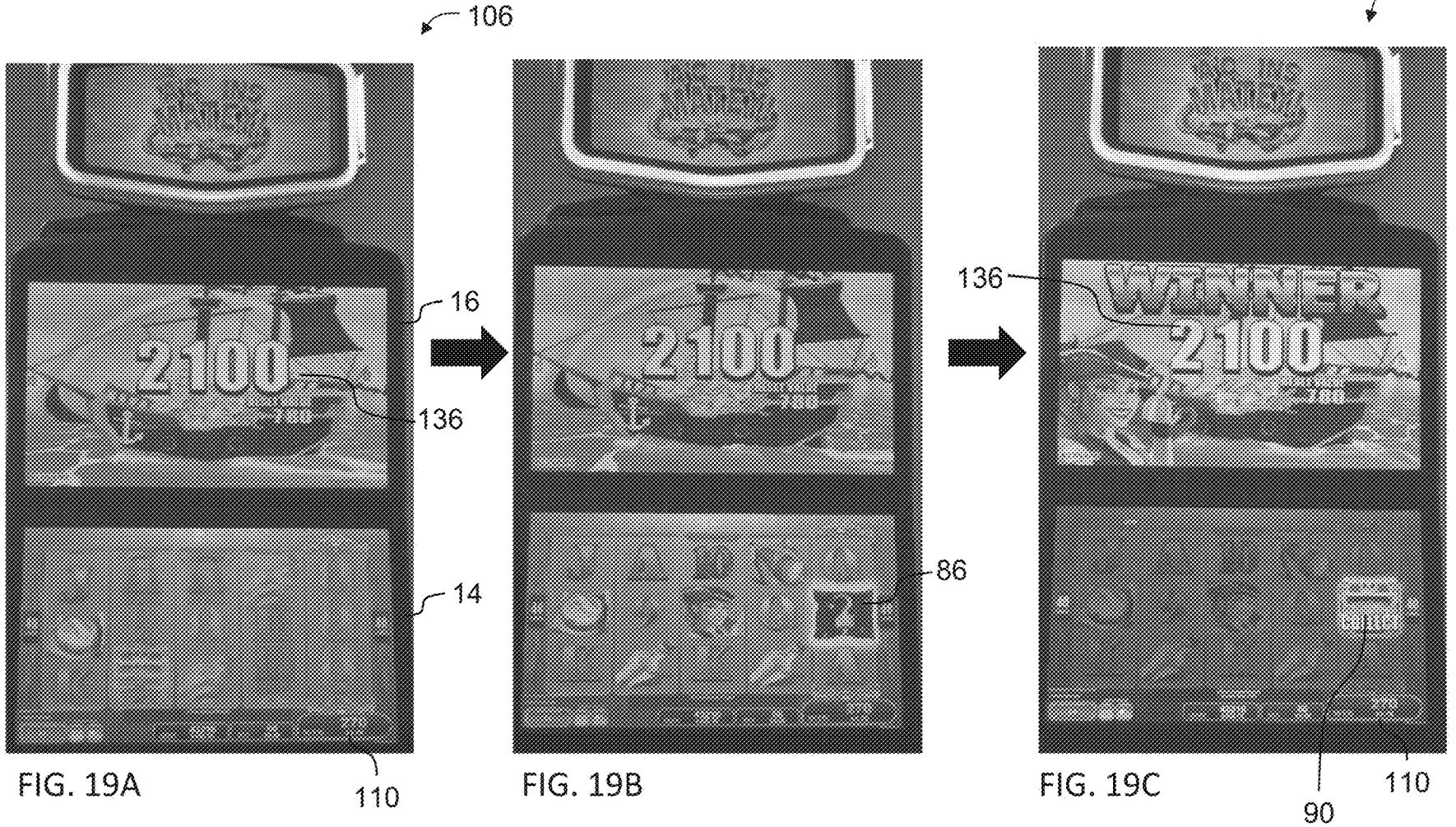
FIGS. 19A-19C are illustrations of a sequence of graphic images that may be used to display the bonus feature game shown in FIGS. 18A-18C, according to an embodiment of the present invention.
Figures 20A, 20B, 20C:
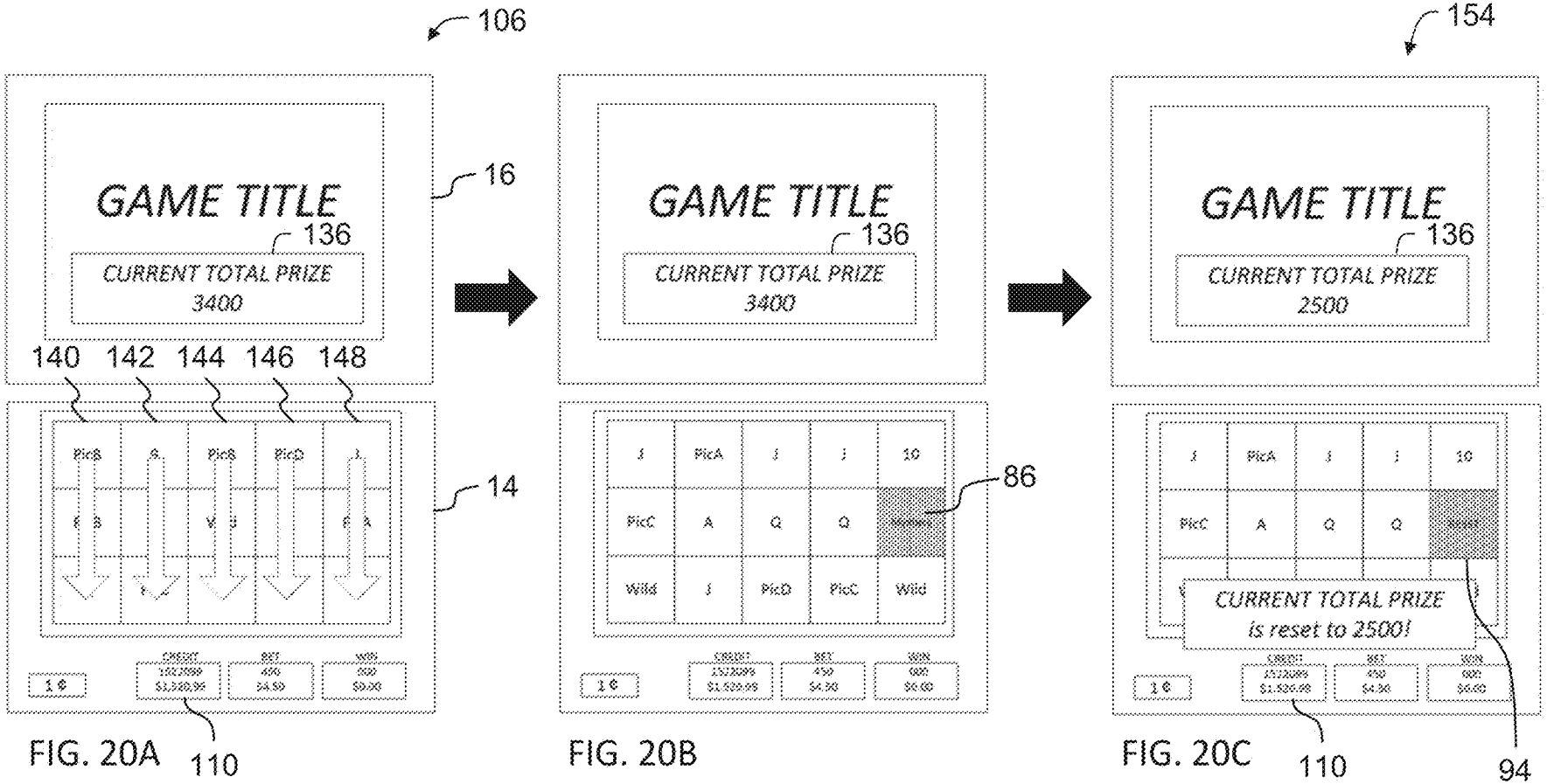
FIGS. 20A-20C are diagrammatic illustrations of the bonus feature game being displayed on the display area of the gaming machine in FIGS. 1A-2, according to an embodiment of the present invention.
Figure 21C:
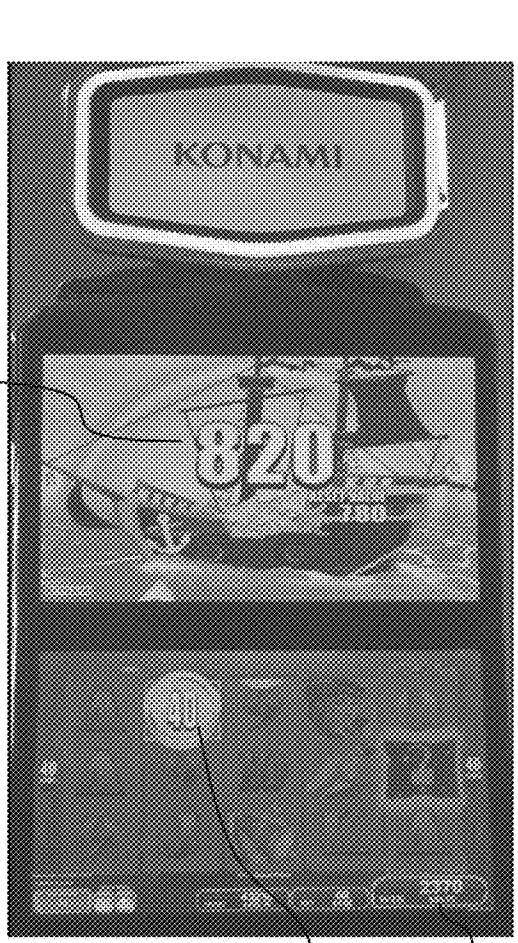
FIGS. 21A-21F are illustrations of a sequence of graphic images that may be used to display the bonus feature game shown in FIGS. 20A-20C, according to an embodiment of the present invention.
Figure 21B:
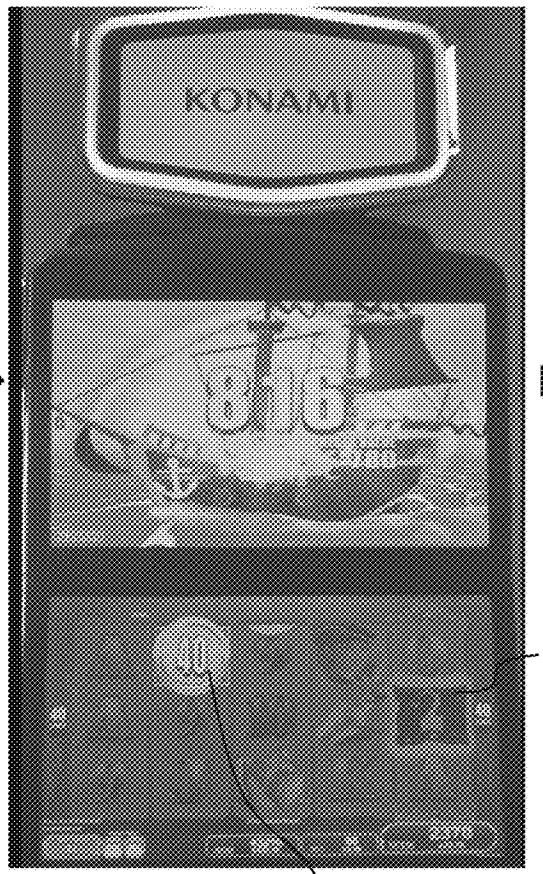
Figure 21A:
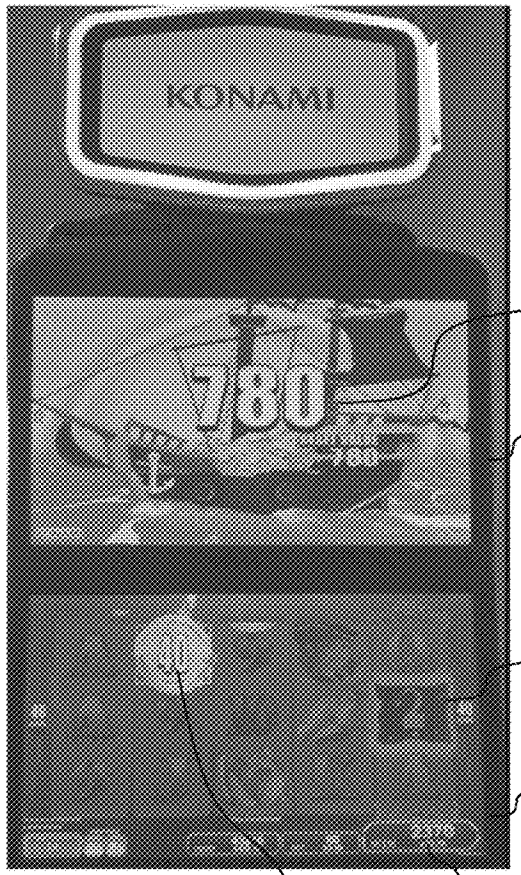
Figure 21F:
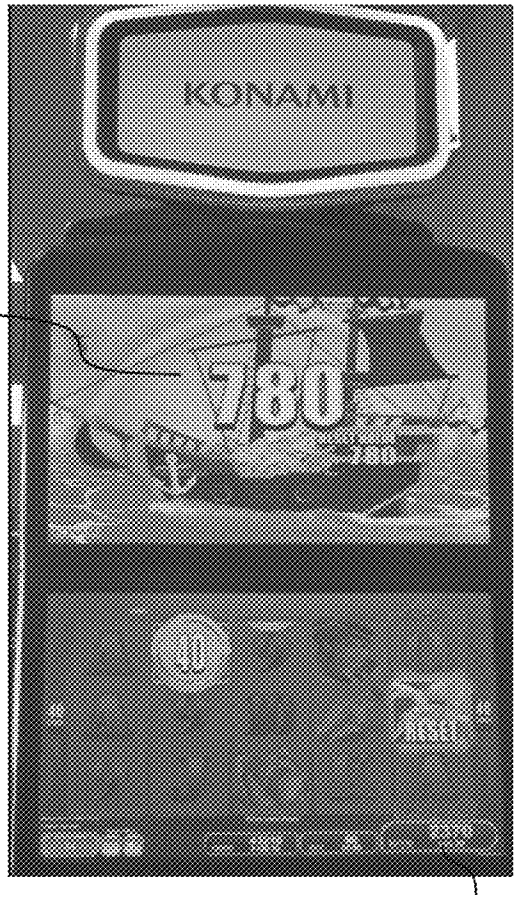
Figure 21E:
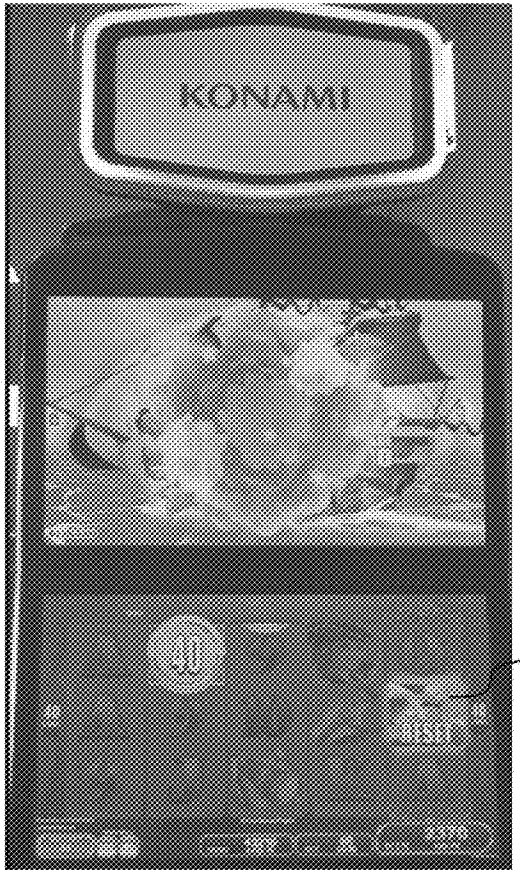
Figure 21D:
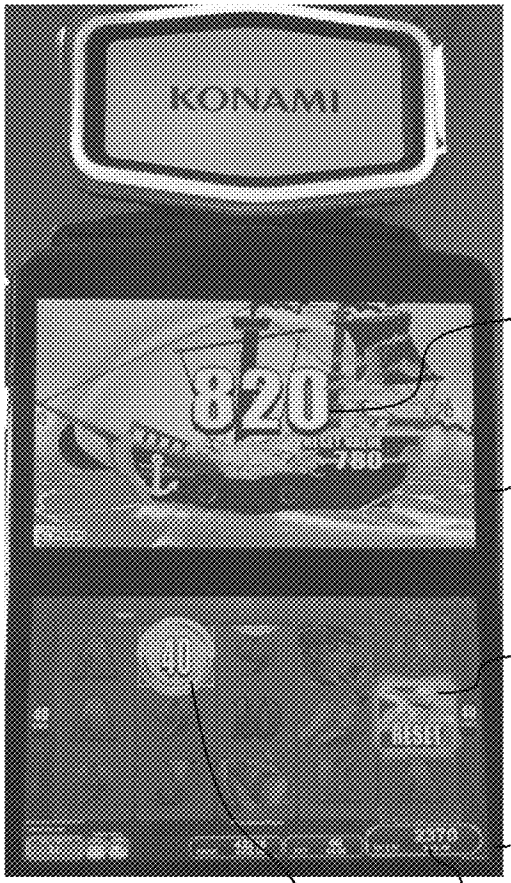
Figure 22C:
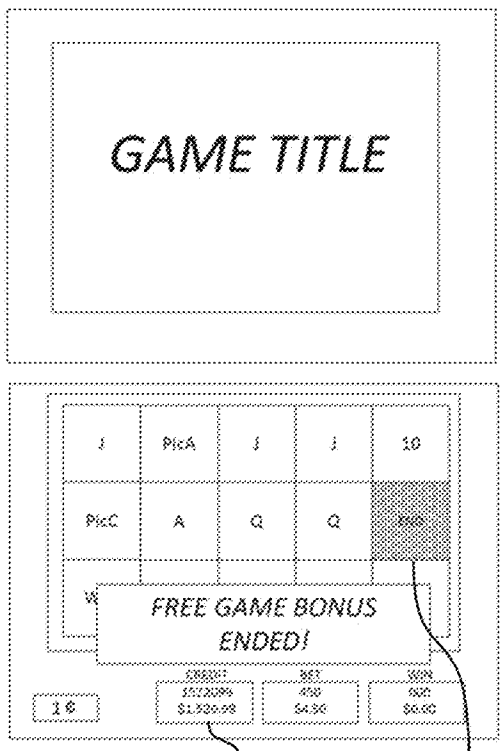
FIGS. 22A-22C are diagrammatic illustrations of the bonus feature game being displayed on the display area of the gaming machine in FIGS. 1A-2, according to an embodiment of the present invention.
Figure 22B:
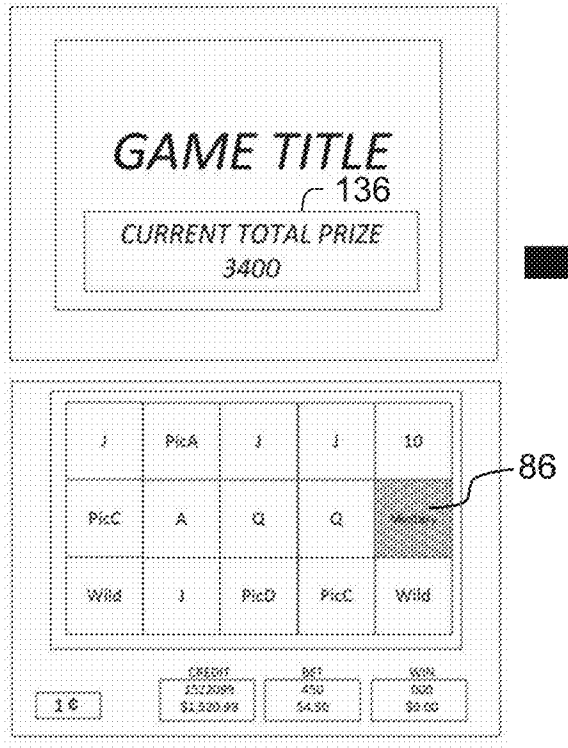
Figure 22A:
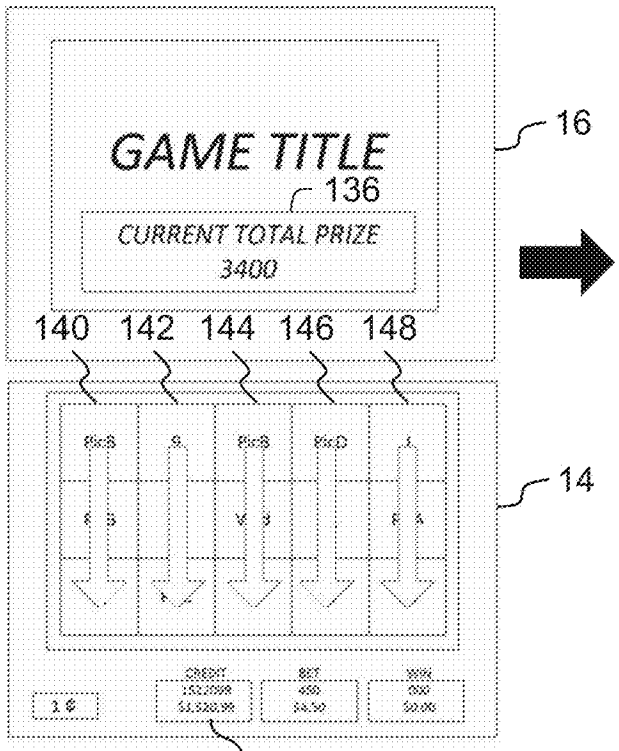
Figure 23C:
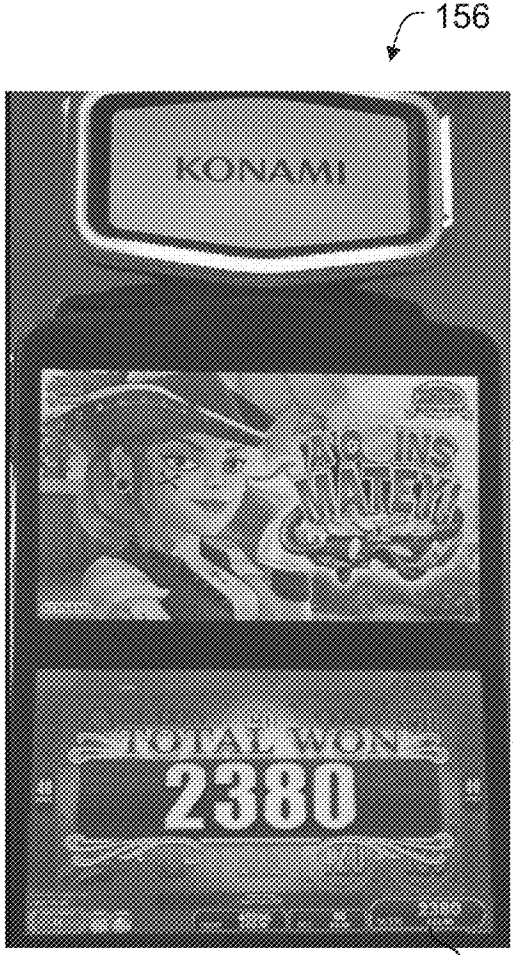
FIGS. 23A-23C are illustrations of a sequence of graphic images that may be used to display the bonus feature game shown in FIGS. 22A-22C, according to an embodiment of the present invention.
Figure 23B:
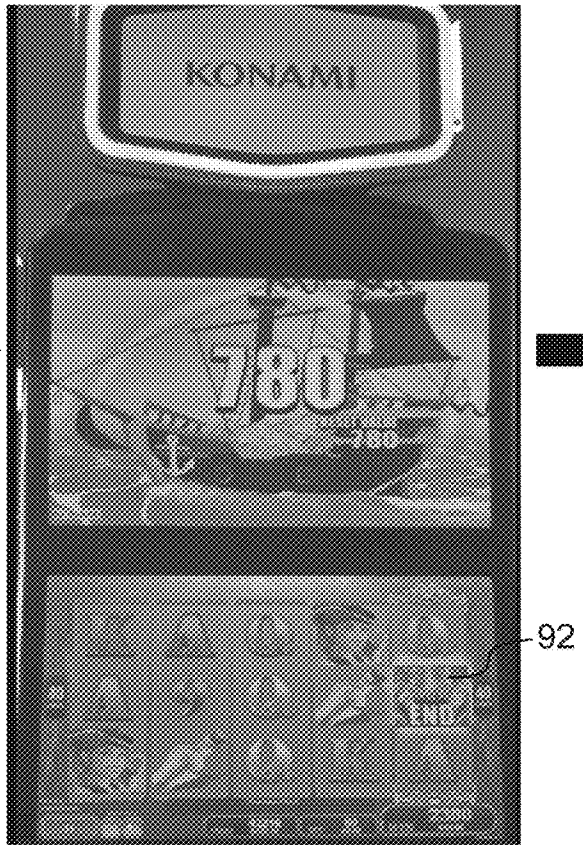
Figure 23A:
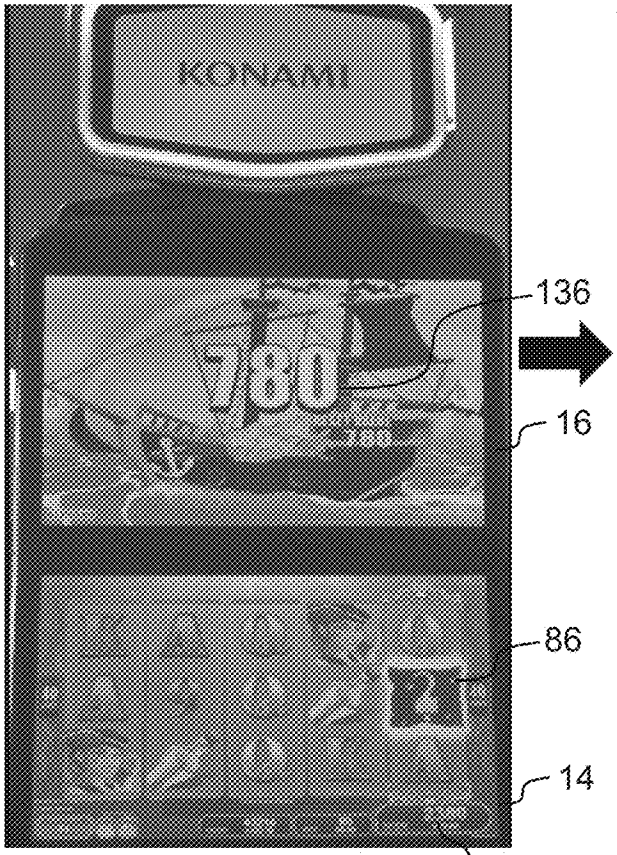
Figure 24:
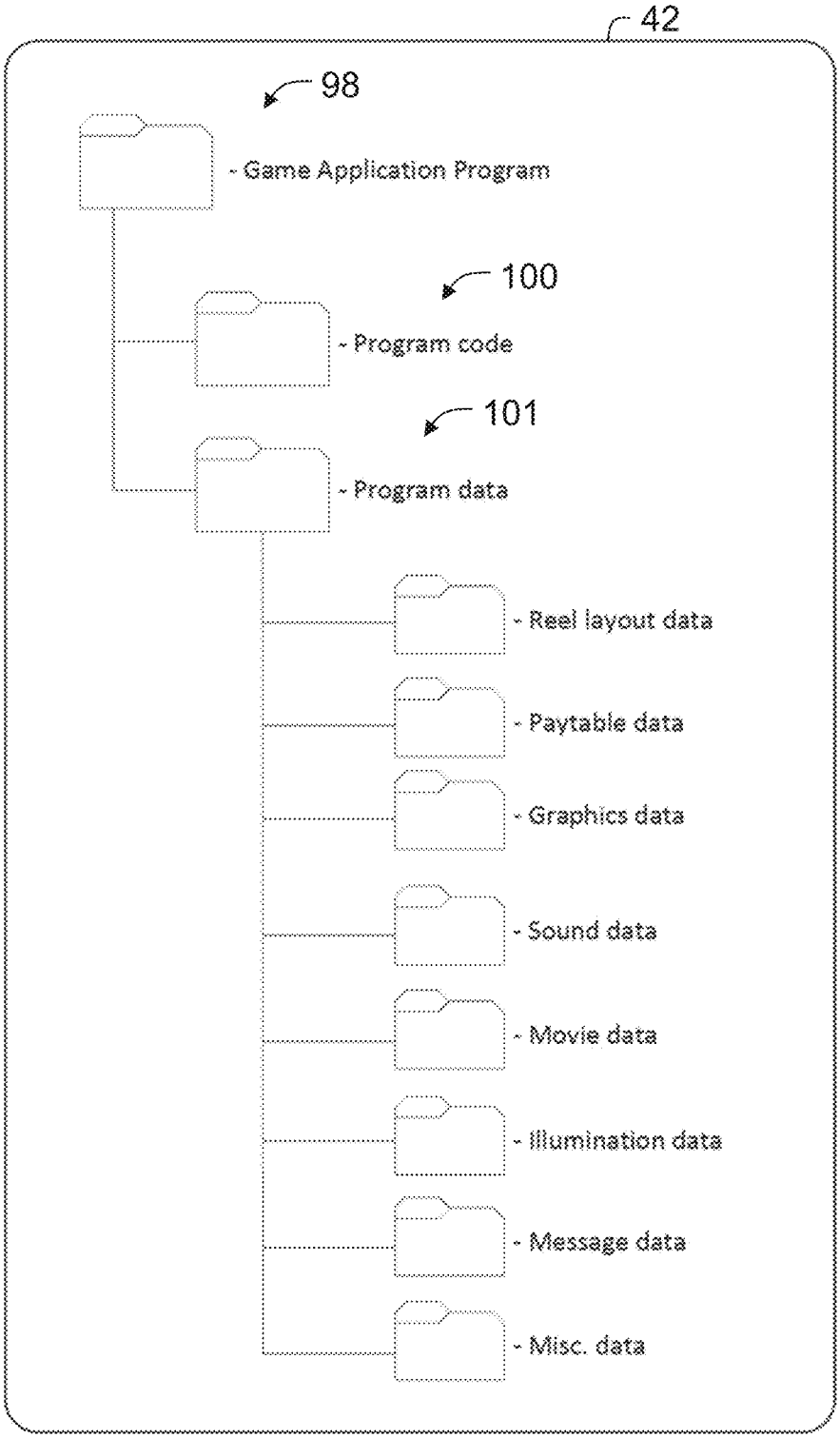

If the processor 38 detects the appearance of a mystery feature event symbol 86 in the outcome, the processor 38 randomly selects an event trigger symbol from a group of symbols including the collect symbol 90 indicating an award of credit values, the end symbol 92 indicating a termination of the bonus feature game, and the reset symbol 94 indicating a reset of a balance of the bonus credit meter. As shown in FIGS. 19B-19C, the processor 38 then removes the mystery feature event symbol 86 from the displayed outcome to reveal the selected event trigger symbol 88. In one embodiment, the processor selects an event trigger symbol 88 from the feature event selection file 160 using random numbers generated by the RNG. Upon selecting the event trigger symbol 88, the processor 38 removes the mystery feature event symbol 86 from the displayed outcome to reveal the selected event trigger symbol 88, and initiates the feature event associated with the selected event trigger symbol 88. A shown in FIGS. 21A-21F, in one embodiment, the processor 38 increases the bonus credit meter 136 based on the credit prize symbols 84 appearing the outcome before revealing the selected event trigger symbol 88 and initiating the feature event.

If the processor 38 selects the collect symbol 90, the processor 38 initiates the bonus credit prize collection event 152, shown in FIGS. 18A-19C. During the bonus credit prize collection event 152, the processor 38 removes the mystery feature event symbol 86 to reveal the collect symbol 90, transfer a current credit balance of the bonus game credit meter 136 to the primary credit balance 110, and resets the bonus game credit meter 136 to the reset credit balance, or the initial credit balance for use with a subsequent instance of the bonus feature game 106. The processor 38 then initiates another instance of the bonus feature game 106 with the bonus game credit meter 136 balance set to the initial balance, and initiates a spin of the bonus virtual reel strips 140 to 148.

If the processor 38 selects the reset symbol 94, the processor 38 initiates the bonus meter reset event 154 (shown in FIG. 20A-21F) and removes the mystery feature event symbol 86, and resets the bonus game credit meter 136 to the initial credit balance for use with the next instance of the bonus feature game 106. The processor 38 then initiates another instance of the bonus feature game 106 with the bonus game credit meter 136 balance set to the initial balance, and initiates a spin of the bonus virtual reel strips 140 to 148.

If the processor 38 randomly selects the end symbol 92, the processor 38 initiates the termination feature event 156 (shown in FIG. 22A-23C), and removes the mystery feature event symbol 86 to reveal the end symbol 92, and terminate the bonus feature game 106 and return the game screen 130 to display the primary game 102.

In one embodiment, the processor 38 is programmed to: pay award based on the displayed Prize symbols if COLLECT symbol appears in the same game result during base game; award Free Game Bonus with setting total value of Prize symbols as initial value of CURRENT TOTAL PRIZE when 6 or more prize symbols appear in the base game; add the value of prize symbols displayed to CURRENT TOTAL VALUE during Free Game bonus; pay award equal to CURRENT TOTAL VALUE when COLLECT appears on the 5th reel; reset the CURRENT TOTAL VALUE when RESET appears on the 5th reel; and end the Free Game bonus only when END appears on the 5th reel.

In other embodiments, the processor 38 may be programmed to not include the RESET symbol in the bonus feature game 106, as it might be more attractive to pay award based on CURRENT TOTAL VALUE when END appears. Alternatively, the number of Free Game Bonus might be determined based on the number of Prize symbols which triggered the Free Game Bonus. Further, the number of Free Game Bonus might be determined based on the total value of Prize symbols. In addition, the value of the Prize symbol might be changed in proportion to Player's bet value. The embodiments of the present invention are described above, but the present invention is not limited to such an embodiment, a variety of variations are possible.

In such an embodiment, a gaming machine 10 providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

In the embodiment, determining the stop position of each reel is described as consecutively acquiring a random number that is used respectively, but the acquisition procedure of the random number is not limited to this. For example, when the game starts, the control unit 22 acquires these random numbers in a batch, and each random number may be stored in the storage area of the non-erasing memory 42 or the storage 44 when power failure occurs. In this type of situation, even when a power failure and the like occurs during a game, because the control unit 22 acquired the random number from the memory 42 or the storage 44 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above when the game starts all of the random numbers are acquired in a batch, and by saving these random numbers in the memory 42 or the storage 44, such great dissatisfaction can be avoided for the player because the progress of a game similar to before a power failure occurred can be reproduced after recovering from a power failure.

In another embodiment, the player may initiate a game through actuation of a spin button (or other button). After initiation of the game, the control unit 22 randomly determines the step position of all reels. The control unit 22 may perform the check for the trigger condition before the reels stop spinning, and thus has already determined the outcome of the game. However, the control unit 22 displays the outcome of the game in a step by step process as discussed above.

Further, in the embodiment, a bill/ticket is displayed as game value, and received by these bill/ticket identification devices (28, 30), and a form where a ticket is output by a printer unit 30 is described, but the present invention is not limited to this. The game value is a concept including tangible objects such as a coin, bill, coin, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Further, in the embodiment when showing a free game provided as a bonus game, a bonus game that uses a different virtual reel strips from a regular game may be provided. Further, there could be a provided a feature game according to a value of the random number acquired during a regular game.

Further, set conditions providing a bonus or feature game are not limited to trigger determination or line determination, for example there may be a configuration providing a bonus game when the bet number surpasses a predetermined value. There could be a configuration providing a bonus game according to a value of the random number acquired during a regular game.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine, comprising:

an operation unit configured to receive an operation input of a player;

a display unit configured to display a game screen including computer generated graphics, the game screen including a display area including a plurality of cells arranged in a grid and configured to display a respective symbol in each cell;

a memory device storing a game execution program including computer instructions for generating a plurality of virtual reel strips including a plurality of game symbols and generating and displaying game instances with the virtual reel strips, wherein the game symbols include a plurality of credit prize symbols indicating various credit amounts and a collect symbol indicating an award of credits; and a game control unit for executing the game, the game control unit including a processor programmed to:

initiate an instance of a primary game upon detecting an operation input of the player via the operation unit including executing the game execution program to generate and display the plurality of virtual reel strips on the game screen, and randomly select stop positions for each of the virtual reel strips;

spin and stop the virtual reel strips based on the randomly selected stop positions to display an outcome of the primary game including game symbols displayed in each cell of the grid;

detect an appearance of a winning combination of game symbols in the outcome and provide an initial award based on the winning combination;

detect an appearance of the collect symbol and at least one credit prize symbol in the outcome and responsively determine an amount of credits associated with the at least one credit prize symbol and provide a bonus award including the determined amount of credits associated with the at least one credit symbol;

adjust a primary credit balance associated with the player based on the initial award and the bonus award;

initiate an instance of a bonus feature game including a bonus game credit meter having an initial credit balance based on the bonus award;

spin and stop the virtual reel strips to display an outcome of the bonus feature game; and upon detecting an appearance of one or more credit prize symbols in the outcome of the bonus feature game, increase a credit balance of the bonus credit meter based on an amount of credits associated with each of the one or more credit prize symbols appearing in the outcome of the bonus feature game; and upon detecting a reset symbol, reset the bonus game credit meter to the initial credit balance for use with a subsequent instance of the bonus feature game.

2. The gaming machine of claim 1, wherein the processor is programmed to:

initiate the bonus feature game upon detecting a triggering condition occurring with the primary game; and display the bonus game credit meter on the game screen.

3. The gaming machine of claim 2, wherein the triggering condition includes a predefined number of credit prize symbols appearing in the outcome of the primary game.

4. The gaming machine of claim 2, wherein the reel generation program includes instructions for generating a plurality of bonus virtual reel strips including a plurality of bonus game symbols, the bonus game symbols including the plurality of credit prize symbols and a mystery feature event symbol indicating an occurrence of a feature event; and wherein the processor is programmed to:

initiate the instance of the bonus feature game including executing the game execution program to generate and display the plurality of bonus virtual reel strips on the game screen, and randomly select stop positions for each of the bonus virtual reel strips; and spin and stop the bonus virtual reel strips to display an outcome of the instance of the bonus feature game including bonus game symbols displayed in each cell of the grid.

5. The gaming machine of claim 4, wherein the processor is programmed to:

detect an appearance of the collect symbol appearing in the outcome of the instance of the bonus feature game; and transfer a current credit balance of the bonus game credit meter to the primary credit balance associated with the player; and reset the bonus game credit meter to the initial credit balance for use with the subsequent instance of the bonus feature game.

6. The gaming machine of claim 4, wherein the processor is programmed to:

detect an appearance of the mystery feature event symbol in the outcome of the instance of the bonus feature game; and upon detecting the appearance of the mystery feature event symbol, randomly select an event trigger symbol from a group of symbols including the collect symbol indicating an award of credit values, an end symbol indicating a termination of the bonus feature game, and the reset symbol indicating a reset of a balance of the bonus credit meter; and remove the mystery feature event symbol from the displayed outcome to reveal the selected event trigger symbol.

7. The gaming machine of claim 6, wherein the processor is programmed to:

upon selecting the collect symbol:

transfer a current credit balance of the bonus game credit meter to the primary credit balance associated with the player; and reset the bonus game credit meter to the initial credit balance for use with a subsequent instance of the bonus feature game.

8. The gaming machine of claim 6 wherein the processor is programmed to:

upon selecting the reset symbol, reset the bonus game credit meter to the initial credit balance for use with a subsequent instance of the bonus feature game.

9. The gaming machine of claim 6, wherein the processor is programmed to:

upon selecting the end symbol, terminate the bonus feature game and display the primary game on the game screen.

10. One or more non-transitory computer-readable storage media, having computer-executable instructions embodied thereon, wherein when executed by a processor, the computer-executable instructions cause the processor to:

display a game screen including computer generated graphics on a display unit, the game screen including a display area including a plurality of cells arranged in a grid and configured to display a respective symbol in each cell;

initiate an instance of a primary game including executing a game execution program including computer instructions for generating a plurality of virtual reel strips including a plurality of game symbols, wherein the game symbols include a plurality of credit prize symbols indicating various credit amounts and a collect symbol indicating an award of credits;

generate and display the plurality of virtual reel strips on the game screen, and randomly select stop positions for each of the virtual reel strips;

spin and stop the virtual reel strips based on the randomly selected stop positions to display an outcome of the primary game including game symbols displayed in each cell of the grid;

detect an appearance of a winning combination of game symbols in the outcome and provide an initial award based on the winning combination;

detect an appearance of the collect symbol and at least one credit prize symbol in the outcome and responsively determine an amount of credits associated with the at least one credit prize symbol and provide a bonus award including the determined amount of credits associated with the at least one credit symbol;

adjust a primary credit balance associated with the player based on the initial award and the bonus award;

initiate an instance of a bonus feature game including a bonus game credit meter having an initial credit balance based on the bonus award;

spin and stop the virtual reel strips to display an outcome of the bonus feature game; and upon detecting an appearance of one or more credit prize symbols in the outcome of the bonus feature game, increase a credit balance of the bonus credit meter based on an amount of credits associated with each of the one or more credit prize symbols appearing in the outcome of the bonus feature game; and upon detecting a reset symbol, reset the bonus game credit meter to the initial credit balance for use with a subsequent instance of the bonus feature game.

11. The one or more non-transitory computer-readable storage media of claim 10, wherein the computer-executable instructions cause the processor to:

initiate the bonus feature game upon detecting a triggering condition occurring with the primary game; and display the bonus game credit meter on the game screen.

12. The one or more non-transitory computer-readable storage media of claim 11, wherein the triggering condition includes a predefined number of credit prize symbols appearing in the outcome of the primary game.

13. The one or more non-transitory computer-readable storage media of claim 11, wherein the computer-executable instructions cause the processor to:

initiate the instance of the bonus feature game including executing the game execution program to generate and display a plurality of bonus virtual reel strips on the game screen, the bonus game symbols including the plurality of credit prize symbols and a mystery feature event symbol indicating an occurrence of a feature event;

randomly select stop positions for each of the bonus virtual reel strips; and spin and stop the bonus virtual reel strips to display an outcome of the instance of the bonus feature game including bonus game symbols displayed in each cell of the grid.

14. The one or more non-transitory computer-readable storage media of claim 13, wherein the computer-executable instructions cause the processor to:

detect an appearance of the collect symbol appearing in the outcome of the instance of the bonus feature game; and transfer a current credit balance of the bonus game credit meter to the primary credit balance associated with the player; and reset the bonus game credit meter to the initial credit balance for use with the subsequent instance of the bonus feature game.

15. The one or more non-transitory computer-readable storage media of claim 13, wherein the computer-executable instructions cause the processor to:

detect an appearance of the mystery feature event symbol in the outcome of the instance of the bonus feature game; and upon detecting the appearance of the mystery feature event symbol, randomly select an event trigger symbol from a group of symbols including the collect symbol indicating an award of credit values, an end symbol indicating a termination of the bonus feature game, and the reset symbol indicating a reset of a balance of the bonus credit meter; and remove the mystery feature event symbol from the displayed outcome to reveal the selected event trigger symbol.

16. The one or more non-transitory computer-readable storage media of claim 15, wherein the computer-executable instructions cause the processor to:

upon selecting the collect symbol:

transfer a current credit balance of the bonus game credit meter to the primary credit balance associated with the player; and reset the bonus game credit meter to the initial credit balance for use with a subsequent instance of the bonus feature game.

17. The one or more non-transitory computer-readable storage media of claim 15, wherein the computer-executable instructions cause the processor to:

upon selecting the reset symbol, reset the bonus game credit meter to the initial credit balance for use with a subsequent instance of the bonus feature game.

18. The one or more non-transitory computer-readable storage media of claim 15, wherein the computer-executable instructions cause the processor to:

upon selecting the end symbol, terminate the bonus feature game and display the primary game on the game screen.

19. A mobile computing device, comprising:

a touch display unit configured to display a game screen including computer generated graphics and receive an operation input of a player, the game screen including a display area including a plurality of cells arranged in a grid and configured to display a respective symbol in each cell; and a processor programmed to:

initiate an instance of a primary game upon detecting an operation input of the player via the operation unit including generating and displaying a plurality of virtual reel strips on the game screen including a plurality of game symbols, the plurality of game symbols include a plurality of credit prize symbols indicating various credit amounts and a collect symbol indicating an award of credits;

randomly select stop positions for each of the virtual reel strips and spin and stop the virtual reel strips based on the randomly selected stop positions to display an outcome of the primary game including game symbols displayed in each cell of the grid;

detect an appearance of a winning combination of game symbols in the outcome and provide an initial award based on the winning combination;

detect an appearance of the collect symbol and at least one credit prize symbol in the outcome and responsively determine an amount of credits associated with the at least one credit prize symbol and provide a bonus award including the determined amount of credits associated with the at least one credit symbol;

adjust a primary credit balance associated with the player based on the initial award and the bonus award;

initiate an instance of a bonus feature game including a bonus game credit meter having an initial credit balance based on the bonus award;

spin and stop the virtual reel strips to display an outcome of the bonus feature game; and upon detecting an appearance of one or more credit prize symbols in the outcome of the bonus feature game, increase a credit balance of the bonus credit meter based on an amount of credits associated with each of the one or more credit prize symbols appearing in the outcome of the bonus feature game; and upon detecting a reset symbol, reset the bonus game credit meter to the initial credit balance for use with a subsequent instance of the bonus feature game.

20. The mobile computing device of claim 19, wherein the processor is programmed to:

initiate the bonus feature game upon detecting a triggering condition occurring with the primary game; and display the bonus game credit meter on the game screen.

* * * * *